US009080409B2

(12) United States Patent
Craney et al.

(10) Patent No.: US 9,080,409 B2
(45) Date of Patent: Jul. 14, 2015

(54) INTEGRAL SPLICE FOR INSULATED CONDUCTORS

(71) Applicant: Shell Oil Company, Houston, TX (US)

(72) Inventors: Trevor Alexander Craney, Katy, TX (US); Gilbert Luis Herrera, Cypress, TX (US); Robert Anthony Shaffer, Cypress, TX (US); Dhruv Arora, Houston, TX (US); Justin Michael Noel, The Woodlands, TX (US)

(73) Assignee: Shell Oil Company, Houston, TX (US)

( * ) Notice: Subject to any disclaimer, the term of this patent is extended or adjusted under 35 U.S.C. 154(b) by 232 days.

(21) Appl. No.: 13/644,422

(22) Filed: Oct. 4, 2012

(65) Prior Publication Data

US 2013/0087383 A1 Apr. 11, 2013

Related U.S. Application Data

(60) Provisional application No. 61/544,804, filed on Oct. 7, 2011.

(51) Int. Cl.

| | |
|---|---|
| ***H02G 15/08*** | (2006.01) |
| ***H01R 43/00*** | (2006.01) |
| ***E21B 36/04*** | (2006.01) |

(52) U.S. Cl.

CPC ..... *E21B 36/04* (2013.01); *Y10T 29/49194* (2015.01); *Y10T 29/49195* (2015.01)

(58) Field of Classification Search

CPC ..... E12B 36/04; Y10T 29/49194; Y10T 29/49195

USPC ..... 174/84 R, 88 R, 73.1; 166/302, 60; 392/301

See application file for complete search history.

(56) References Cited

U.S. PATENT DOCUMENTS

| | | | |
|---|---|---|---|
| 1,457,690 | A | 6/1923 | Brine |
| 1,477,802 | A | 12/1923 | Beck |

(Continued)

FOREIGN PATENT DOCUMENTS

| | | |
|---|---|---|
| CA | 899987 | 5/1972 |
| CA | 1253555 | 5/1989 |

(Continued)

OTHER PUBLICATIONS

U.S. Patent and Trademark Office, Office Communication for U.S. Appl. No. 12/576,772; mailed Dec. 12, 2012.

(Continued)

*Primary Examiner* — Hoa C Nguyen
*Assistant Examiner* — Amol Patel

(57) ABSTRACT

A method includes coupling a core of a heating section to a core of an overburden section of an insulated conductor. A diameter of the core of the heating section is less than a diameter of the core of the overburden section. A first insulation layer is placed over the core of the heating section such that at least part of an end portion of the core of the heating section is exposed. A second insulation layer is placed over the core of the overburden section such that the second insulation layer extends over the exposed portion of the core of the heating section. A thickness of the second insulation layer is less than a thickness of the first insulation layer and an outer diameter of the overburden section is substantially the same as an outer diameter of the heating section.

29 Claims, 5 Drawing Sheets

(56) References Cited

U.S. PATENT DOCUMENTS

| | | | | |
|---|---|---|---|---|
| 2,011,710 | A | 8/1935 | Davis | |
| 2,078,051 | A | 4/1937 | Berndt | |
| 2,208,087 | A | 7/1940 | Somers | |
| 2,244,255 | A | 6/1941 | Looman | |
| 2,595,728 | A | 5/1952 | Swiss | |
| 2,634,961 | A | 4/1953 | Ljungstrom | 262/3 |
| 2,680,086 | A | 6/1954 | Hollingsworth et al. | |
| 2,732,195 | A | 1/1956 | Ljungstrom | 262/3 |
| 2,757,739 | A | 8/1956 | Douglas et al. | |
| 2,780,450 | A | 2/1957 | Ljungstrom | 262/3 |
| 2,789,805 | A | 4/1957 | Ljungstrom | 262/3 |
| 2,794,504 | A | 6/1957 | Carpenter | |
| 2,923,535 | A | 2/1960 | Ljungstrom | 262/3 |
| 2,937,228 | A | 5/1960 | Robinson | |
| 2,942,223 | A | 6/1960 | Lennox et al. | |
| 3,026,940 | A | 3/1962 | Spitz | |
| 3,114,417 | A | 12/1963 | McCarthy | |
| 3,131,763 | A | 5/1964 | Kunetka et al. | |
| 3,141,924 | A | 7/1964 | Forney, Jr. | |
| 3,149,672 | A | 9/1964 | Orkiszewski et al. | |
| 3,207,220 | A | 9/1965 | Williams | |
| 3,220,479 | A | 11/1965 | Orloff et al. | |
| 3,278,673 | A | 10/1966 | Gore | |
| 3,299,202 | A | 1/1967 | Brown | |
| 3,316,344 | A | 4/1967 | Kidd et al. | |
| 3,342,267 | A | 9/1967 | Cotter et al. | |
| 3,384,704 | A | 5/1968 | Vockroth | |
| 3,410,977 | A | 11/1968 | Ando | |
| 3,477,058 | A | 11/1969 | Vedder et al. | |
| 3,492,463 | A | 1/1970 | Wringer et al. | |
| 3,515,213 | A | 6/1970 | Prats | |
| 3,515,837 | A | 6/1970 | Ando | |
| 3,547,192 | A | 12/1970 | Claridge et al. | |
| 3,562,401 | A | 2/1971 | Long | |
| 3,580,987 | A | 5/1971 | Priaroggia | |
| 3,614,387 | A | 10/1971 | Wrob et al. | |
| 3,629,551 | A | 12/1971 | Ando | |
| 3,657,520 | A | 4/1972 | Ragault | |
| 3,672,196 | A | 6/1972 | Levacher et al. | |
| 3,679,812 | A | 7/1972 | Owens | |
| 3,685,148 | A | 8/1972 | Garfinkel | |
| 3,757,860 | A | 9/1973 | Pritchett | |
| 3,761,599 | A | 9/1973 | Beatty | |
| 3,790,697 | A | 2/1974 | Buckingham | |
| 3,798,349 | A | 3/1974 | Thompson et al. | |
| 3,844,352 | A | 10/1974 | Garrett | |
| 3,859,503 | A | 1/1975 | Palone | |
| 3,893,961 | A | 7/1975 | Walton et al. | |
| 3,895,180 | A | 7/1975 | Plummer | |
| 3,896,260 | A | 7/1975 | Plummer | |
| 3,955,043 | A | 5/1976 | Palmer et al. | |
| 4,001,760 | A | 1/1977 | Howie et al. | |
| 4,110,550 | A | 8/1978 | Di Pietro | |
| 4,234,755 | A | 11/1980 | Simons | |
| 4,256,945 | A | 3/1981 | Carter et al. | |
| 4,266,992 | A | 5/1981 | Agaisse | |
| 4,280,046 | A | 7/1981 | Shimotori et al. | |
| 4,317,003 | A | 2/1982 | Gray | |
| 4,344,483 | A | 8/1982 | Fisher et al. | |
| 4,354,053 | A | 10/1982 | Gold | |
| 4,365,947 | A | 12/1982 | Bahder et al. | |
| 4,368,452 | A | 1/1983 | Kerr, Jr. | |
| 4,370,518 | A | 1/1983 | Guzy | |
| 4,403,110 | A | 9/1983 | Morrisette | |
| 4,470,459 | A | 9/1984 | Copeland et al. | |
| 4,477,376 | A | 10/1984 | Gold | |
| 4,484,022 | A | 11/1984 | Eilentropp | |
| 4,496,795 | A | 1/1985 | Konnik | |
| 4,520,229 | A | 5/1985 | Luzzi et al. | |
| 4,524,827 | A | 6/1985 | Bridges et al. | |
| 4,532,375 | A | 7/1985 | Weitzel et al. | |
| 4,538,682 | A | 9/1985 | McManus et al. | |
| 4,549,073 | A | 10/1985 | Tamura et al. | |
| 4,570,715 | A | 2/1986 | Van Meurs et al. | |
| 4,572,299 | A | 2/1986 | Van Egmond et al. | |
| 4,585,066 | A | 4/1986 | Moore et al. | |
| 4,614,392 | A | 9/1986 | Moore | |
| 4,623,401 | A | 11/1986 | Derbyshire et al. | |
| 4,626,665 | A | 12/1986 | Fort, III | |
| 4,639,712 | A | 1/1987 | Kobayashi et al. | |
| 4,645,906 | A | 2/1987 | Yagnik et al. | |
| 4,662,437 | A | 5/1987 | Renfro et al. | |
| 4,694,907 | A | 9/1987 | Stahl et al. | |
| 4,695,713 | A | 9/1987 | Krumme | |
| 4,698,583 | A | 10/1987 | Sandberg | |
| 4,701,587 | A | 10/1987 | Carter et al. | |
| 4,704,514 | A | 11/1987 | Van Egmond et al. | |
| 4,716,960 | A | 1/1988 | Eastlund et al. | |
| 4,717,814 | A | 1/1988 | Krumme | |
| 4,733,057 | A | 3/1988 | Stanzel et al. | |
| 4,752,673 | A | 6/1988 | Krumme | |
| 4,785,163 | A | 11/1988 | Sandberg | |
| 4,786,760 | A | 11/1988 | Friedhelm | |
| 4,793,409 | A * | 12/1988 | Bridges et al. | 166/57 |
| 4,794,226 | A | 12/1988 | Derbyshire | |
| 4,814,587 | A | 3/1989 | Carter | |
| 4,821,798 | A | 4/1989 | Bridges et al. | |
| 4,834,825 | A | 5/1989 | Adams et al. | |
| 4,837,409 | A | 6/1989 | Klosin | |
| 4,849,611 | A | 7/1989 | Whitney et al. | |
| 4,859,200 | A | 8/1989 | McIntosh et al. | |
| 4,886,118 | A | 12/1989 | Van Meurs et al. | 166/245 |
| 4,947,672 | A | 8/1990 | Pecora et al. | |
| 4,979,296 | A | 12/1990 | Langner et al. | |
| 4,985,313 | A | 1/1991 | Penneck et al. | |
| 5,040,601 | A | 8/1991 | Karlsson et al. | |
| 5,060,287 | A | 10/1991 | Van Egmond | |
| 5,065,501 | A | 11/1991 | Henschen et al. | |
| 5,065,818 | A | 11/1991 | Van Egmond | |
| 5,066,852 | A | 11/1991 | Willbanks | |
| 5,070,533 | A | 12/1991 | Bridges et al. | |
| 5,073,625 | A | 12/1991 | Derbyshire | |
| 5,082,494 | A | 1/1992 | Crompton | |
| 5,117,912 | A | 6/1992 | Young | |
| 5,152,341 | A | 10/1992 | Kaservich | |
| 5,182,427 | A | 1/1993 | McGaffigan | |
| 5,189,283 | A | 2/1993 | Carl, Jr. et al. | |
| 5,207,273 | A | 5/1993 | Cates et al. | |
| 5,209,987 | A | 5/1993 | Penneck et al. | |
| 5,226,961 | A | 7/1993 | Nahm et al. | |
| 5,231,249 | A | 7/1993 | Kimura et al. | |
| 5,245,161 | A | 9/1993 | Okamoto | |
| 5,246,783 | A | 9/1993 | Spenadel et al. | |
| 5,278,353 | A | 1/1994 | Buchholz et al. | |
| 5,289,882 | A | 3/1994 | Moore | |
| 5,315,065 | A | 5/1994 | O'Donovan | |
| 5,316,492 | A | 5/1994 | Schaareman | |
| 5,336,851 | A | 8/1994 | Sawada et al. | |
| 5,403,977 | A | 4/1995 | Steptoe et al. | |
| 5,406,030 | A | 4/1995 | Boggs | |
| 5,408,047 | A | 4/1995 | Wentzel | |
| 5,453,599 | A | 9/1995 | Hall, Jr. | |
| 5,463,187 | A | 10/1995 | Battle et al. | |
| 5,483,414 | A | 1/1996 | Turtiainen | |
| 5,512,732 | A | 4/1996 | Yagnik et al. | |
| 5,528,824 | A | 6/1996 | Anthony et al. | |
| 5,553,478 | A | 9/1996 | Di Troia | |
| 5,579,575 | A | 12/1996 | Lamome et al. | |
| 5,594,211 | A | 1/1997 | Di Troia et al. | |
| 5,606,148 | A | 2/1997 | Escherich et al. | |
| 5,619,611 | A | 4/1997 | Loschen et al. | |
| 5,621,844 | A | 4/1997 | Bridges | |
| 5,667,009 | A | 9/1997 | Moore | |
| 5,669,275 | A | 9/1997 | Mills | |
| 5,683,273 | A | 11/1997 | Garver et al. | |
| 5,713,415 | A | 2/1998 | Bridges | |
| 5,782,301 | A | 7/1998 | Neuroth et al. | |
| 5,784,530 | A | 7/1998 | Bridges | |
| 5,788,376 | A | 8/1998 | Sultan et al. | |
| 5,801,332 | A | 9/1998 | Berger et al. | |
| 5,854,472 | A | 12/1998 | Wildi | |
| 5,875,283 | A | 2/1999 | Yane et al. | |
| 5,911,898 | A | 6/1999 | Jacobs et al. | |
| 5,987,745 | A | 11/1999 | Hoglund et al. | |

(56) References Cited

U.S. PATENT DOCUMENTS 6,015,015 A 1/2000 Luft et al.
6,023,554 A 2/2000 Vinegar et al.
6,056,057 A 5/2000 Vinegar et al.
6,079,499 A 6/2000 Mikus et al.
6,102,122 A 8/2000 de Rouffignac
6,269,876 B1 8/2001 de Rouffignac et al.
6,288,372 B1 9/2001 Sandberg et al.
6,313,431 B1 11/2001 Schneider et al.
6,326,546 B1 12/2001 Karlsson
6,355,318 B1 3/2002 Tailor et al.
6,364,721 B2 4/2002 Stewart, III
6,423,952 B1 7/2002 Meisiek
6,452,105 B2 9/2002 Badii et al.
6,472,600 B1 10/2002 Osmani et al.
6,581,684 B2 6/2003 Wellington et al.
6,583,351 B1 6/2003 Artman
6,585,046 B2 7/2003 Neuroth et al.
6,588,503 B2 7/2003 Karanikas et al.
6,588,504 B2 7/2003 Wellington et al.
6,591,906 B2 7/2003 Wellington et al.
6,591,907 B2 7/2003 Zhang et al.
6,607,033 B2 8/2003 Wellington et al.
6,609,570 B2 8/2003 Wellington et al.
6,688,387 B1 2/2004 Wellington et al. ..... 166/245
6,698,515 B2 3/2004 Karanikas et al. ..... 166/245
6,702,016 B2 3/2004 de Rouffignac et al.
6,712,135 B2 3/2004 Wellington et al.
6,712,136 B2 3/2004 de Rouffignac et al.
6,712,137 B2 3/2004 Vinegar et al.
6,715,546 B2 4/2004 Vinegar et al.
6,715,547 B2 4/2004 Vinegar et al.
6,715,548 B2 4/2004 Wellington et al.
6,715,549 B2 4/2004 Wellington et al.
6,719,047 B2 4/2004 Fowler et al.
6,722,429 B2 4/2004 de Rouffignac et al.
6,722,430 B2 4/2004 Vinegar et al.
6,722,431 B2 4/2004 Karanikas et al.
6,725,920 B2 4/2004 Zhang et al.
6,725,928 B2 4/2004 Vinegar et al.
6,729,395 B2 5/2004 Shahin, Jr. et al.
6,729,396 B2 5/2004 Vinegar et al.
6,729,397 B2 5/2004 Zhang et al.
6,729,401 B2 5/2004 Vinegar et al.
6,732,794 B2 5/2004 Wellington et al.
6,732,795 B2 5/2004 de Rouffignac et al.
6,732,796 B2 5/2004 Vinegar et al.
6,736,215 B2 5/2004 Maher et al.
6,739,393 B2 5/2004 Vinegar et al.
6,739,394 B2 5/2004 Vinegar et al.
6,742,587 B2 6/2004 Vinegar et al.
6,742,588 B2 6/2004 Wellington et al.
6,742,589 B2 6/2004 Berchenko et al.
6,742,593 B2 6/2004 Vinegar et al.
6,745,831 B2 6/2004 de Rouffignac et al.
6,745,832 B2 6/2004 Wellington et al.
6,745,837 B2 6/2004 Wellington et al.
6,749,021 B2 6/2004 Vinegar et al.
6,752,210 B2 6/2004 de Rouffignac et al.
6,758,268 B2 7/2004 Vinegar et al.
6,761,216 B2 7/2004 Vinegar et al.
6,769,483 B2 8/2004 de Rouffignac et al.
6,769,485 B2 8/2004 Vinegar et al.
6,773,311 B2 8/2004 Mello et al.
6,782,947 B2 8/2004 de Rouffignac et al. ..... 166/245
6,789,625 B2 9/2004 de Rouffignac et al.
6,805,195 B2 10/2004 Vinegar et al.
6,820,688 B2 11/2004 Vinegar et al.
6,849,800 B2 2/2005 Mazurkiewicz
6,866,097 B2 3/2005 Vinegar et al.
6,871,707 B2 3/2005 Karanikas et al.
6,877,554 B2 4/2005 Stegemeier et al.
6,877,555 B2 4/2005 Karanikas et al.
6,880,633 B2 4/2005 Wellington et al. ..... 166/245
6,880,635 B2 4/2005 Vinegar et al.
6,886,638 B2 5/2005 Ahmed et al.
6,889,769 B2 5/2005 Wellington et al.
6,896,053 B2 5/2005 Berchenko et al.
6,902,003 B2 6/2005 Maher et al.
6,902,004 B2 6/2005 de Rouffignac et al.
6,910,536 B2 6/2005 Wellington et al.
6,913,078 B2 7/2005 Shahin, Jr. et al.
6,915,850 B2 7/2005 Vinegar et al.
6,918,442 B2 7/2005 Wellington et al.
6,918,443 B2 7/2005 Wellington et al.
6,923,257 B2 8/2005 Wellington et al.
6,923,258 B2 8/2005 Wellington et al.
6,929,067 B2 8/2005 Vinegar et al.
6,932,155 B2 8/2005 Vinegar et al.
6,942,032 B2 9/2005 La Rovere et al.
6,948,562 B2 9/2005 Wellington et al.
6,948,563 B2 9/2005 Wellington et al.
6,951,247 B2 10/2005 de Rouffignac et al.
6,953,087 B2 10/2005 de Rouffignac et al.
6,958,704 B2 10/2005 Vinegar et al.
6,959,761 B2 11/2005 Berchenko et al.
6,963,053 B2 11/2005 Lutz
6,964,300 B2 11/2005 Vinegar et al.
6,966,372 B2 11/2005 Wellington et al.
6,966,374 B2 11/2005 Vinegar et al.
6,969,123 B2 11/2005 Vinegar et al.
6,973,967 B2 12/2005 Stegemeier et al.
6,981,548 B2 1/2006 Wellington et al.
6,991,032 B2 1/2006 Berchenko et al.
6,991,033 B2 1/2006 Wellington et al.
6,991,036 B2 1/2006 Sumnu-Dindoruk et al. 166/302
6,991,045 B2 1/2006 Vinegar et al. ..... 175/45
6,994,160 B2 2/2006 Wellington et al.
6,994,161 B2 2/2006 Maher et al.
6,994,168 B2 2/2006 Wellington et al.
6,994,169 B2 2/2006 Zhang et al.
6,997,255 B2 2/2006 Wellington et al.
6,997,518 B2 2/2006 Vinegar et al.
7,004,247 B2 2/2006 Cole et al.
7,004,251 B2 2/2006 Ward et al.
7,011,154 B2 3/2006 Maher et al.
7,013,972 B2 3/2006 Vinegar et al.
7,036,583 B2 5/2006 de Rouffignac et al.
7,040,397 B2 5/2006 de Rouffignac et al.
7,040,398 B2 5/2006 Wellington et al.
7,040,399 B2 5/2006 Wellington et al.
7,040,400 B2 5/2006 de Rouffignac et al.
7,051,807 B2 5/2006 Vinegar et al.
7,051,808 B1 5/2006 Vinegar et al.
7,051,811 B2 5/2006 de Rouffignac et al.
7,055,600 B2 6/2006 Messier et al.
7,063,145 B2 6/2006 Veenstra et al.
7,066,254 B2 6/2006 Vinegar et al.
7,066,257 B2 6/2006 Wellington et al.
7,073,578 B2 7/2006 Vinegar et al. ..... 166/245
7,077,198 B2 7/2006 Vinegar et al.
7,077,199 B2 7/2006 Vinegar et al.
7,086,465 B2 8/2006 Wellington et al.
7,086,468 B2 8/2006 de Rouffignac et al.
7,090,013 B2 8/2006 Wellington et al.
7,096,941 B2 8/2006 de Rouffignac et al.
7,096,942 B1 8/2006 de Rouffignac et al.
7,096,953 B2 8/2006 de Rouffignac et al.
7,100,994 B2 9/2006 Vinegar et al.
7,104,319 B2 9/2006 Vinegar et al.
7,114,566 B2 10/2006 Vinegar et al.
7,121,341 B2 10/2006 Vinegar et al.
7,121,342 B2 10/2006 Vinegar et al. ..... 166/302
7,128,153 B2 10/2006 Vinegar et al.
7,153,373 B2 12/2006 Maziasz et al.
7,156,176 B2 1/2007 Vinegar et al.
7,165,615 B2 1/2007 Vinegar et al.
7,172,038 B2 2/2007 Terry et al.
7,219,734 B2 5/2007 Bai et al.
7,225,866 B2 6/2007 Berchenko et al.
7,258,752 B2 8/2007 Maziasz et al.
7,320,364 B2 1/2008 Fairbanks ..... 166/302
7,337,841 B2 3/2008 Ravi
7,353,872 B2 4/2008 Sandberg et al.
7,357,180 B2 4/2008 Vinegar et al.

(56) References Cited

U.S. PATENT DOCUMENTS 7,360,588 B2 4/2008 Vinegar et al.
7,370,704 B2 5/2008 Harris
7,383,877 B2 6/2008 Vinegar et al.
7,398,823 B2 7/2008 Montgomery et al.
7,405,358 B2 7/2008 Emerson
7,424,915 B2 9/2008 Vinegar et al.
7,431,076 B2 10/2008 Sandberg et al.
7,435,037 B2 10/2008 McKinzie, II
7,461,691 B2 12/2008 Vinegar et al.
7,481,274 B2 1/2009 Vinegar et al.
7,490,665 B2 2/2009 Sandberg et al.
7,500,528 B2 3/2009 McKinzie et al.
7,510,000 B2 3/2009 Pastor-Sanz et al.
7,527,094 B2 5/2009 McKinzie et al. ..... 166/250.07
7,533,719 B2 5/2009 Hinson et al. ..... 166/75.11
7,540,324 B2 6/2009 de Rouffignac et al.
7,546,873 B2 6/2009 Kim
7,549,470 B2 6/2009 Vinegar et al.
7,556,095 B2 7/2009 Vinegar
7,556,096 B2 7/2009 Vinegar et al.
7,559,367 B2 7/2009 Vinegar et al.
7,559,368 B2 7/2009 Vinegar et al.
7,562,706 B2 7/2009 Li et al.
7,562,707 B2 7/2009 Miller ..... 166/245
7,563,983 B2 7/2009 Bryant
7,575,052 B2 8/2009 Sandberg et al.
7,575,053 B2 8/2009 Vinegar et al.
7,581,589 B2 9/2009 Roes et al.
7,584,789 B2 9/2009 Mo et al. ..... 166/267
7,591,310 B2 9/2009 Minderhoud et al.
7,597,147 B2 10/2009 Vitek et al.
7,604,052 B2 10/2009 Roes et al.
7,610,962 B2 11/2009 Fowler
7,631,689 B2 12/2009 Vinegar et al.
7,631,690 B2 12/2009 Vinegar et al.
7,635,023 B2 12/2009 Goldberg et al.
7,635,024 B2 12/2009 Karanikas et al.
7,635,025 B2 12/2009 Vinegar et al.
7,640,980 B2 1/2010 Vinegar et al.
7,644,765 B2 1/2010 Stegemeier et al.
7,673,681 B2 3/2010 Vinegar et al.
7,673,786 B2 3/2010 Menotti
7,677,310 B2 3/2010 Vinegar et al.
7,677,314 B2 3/2010 Hsu
7,681,647 B2 3/2010 Mudunuri et al.
7,683,296 B2 3/2010 Brady et al.
7,703,513 B2 4/2010 Vinegar et al.
7,717,171 B2 5/2010 Stegemeier et al.
7,730,936 B2 6/2010 Hernandez-Solis et al.
7,730,945 B2 6/2010 Pietersen et al.
7,730,946 B2 6/2010 Vinegar et al.
7,730,947 B2 6/2010 Stegemeier et al.
7,735,935 B2 6/2010 Vinegar et al.
7,764,871 B2 7/2010 Rodegher
7,785,427 B2 8/2010 Maziasz et al.
7,793,722 B2 9/2010 Vinegar et al.
7,798,220 B2 9/2010 Vinegar et al. ..... 166/272.3
7,798,221 B2 9/2010 Vinegar et al.
7,831,133 B2 11/2010 Vinegar et al.
7,831,134 B2 11/2010 Vinegar et al.
7,832,484 B2 11/2010 Nguyen et al.
7,841,401 B2 11/2010 Kuhlman et al.
7,841,408 B2 11/2010 Vinegar
7,841,425 B2 11/2010 Mansure et al.
7,845,411 B2 12/2010 Vinegar et al.
7,849,922 B2 12/2010 Vinegar et al.
7,860,377 B2 12/2010 Vinegar et al.
7,866,385 B2 1/2011 Lambirth
7,866,386 B2 1/2011 Beer
7,866,388 B2 1/2011 Bravo
7,912,358 B2 3/2011 Stone et al.
7,931,086 B2 4/2011 Nguyen et al.
7,942,197 B2 5/2011 Fairbanks et al.
7,942,203 B2 5/2011 Vinegar et al.
7,950,453 B2 5/2011 Farmayan et al.
7,986,869 B2 7/2011 Vinegar et al.
8,011,451 B2 9/2011 MacDonald
8,027,571 B2 9/2011 Vinegar et al.
8,042,610 B2 10/2011 Harris et al.
8,083,813 B2 12/2011 Nair et al.
8,113,272 B2 2/2012 Vinegar
8,122,957 B2 2/2012 Stephenson et al.
8,146,661 B2 4/2012 Bravo et al.
8,146,669 B2 4/2012 Mason
8,151,880 B2 4/2012 Roes et al.
8,151,907 B2 4/2012 MacDonald
8,162,059 B2 4/2012 Nguyen et al.
8,162,405 B2 4/2012 Burns et al.
8,172,335 B2 5/2012 Burns et al.
8,177,305 B2 5/2012 Burns et al.
8,191,630 B2 6/2012 Stegemeier et al.
8,192,682 B2 6/2012 Maziasz et al.
8,196,658 B2 6/2012 Miller et al.
8,200,072 B2 6/2012 Vinegar et al.
8,220,539 B2 7/2012 Vinegar et al.
8,224,164 B2 7/2012 Sandberg et al.
8,224,165 B2 7/2012 Vinegar et al.
8,225,866 B2 7/2012 de Rouffignac
8,230,927 B2 7/2012 Fairbanks et al.
8,233,782 B2 7/2012 Vinegar et al.
8,238,730 B2 8/2012 Sandberg et al.
8,256,512 B2 9/2012 Stanecki
8,257,112 B2 9/2012 Tilley
8,261,832 B2 9/2012 Ryan
8,267,170 B2 9/2012 Fowler et al.
8,276,661 B2 10/2012 Costello et al.
8,281,861 B2 10/2012 Nguyen et al.
8,327,932 B2 12/2012 Karanikas
8,353,347 B2 1/2013 Mason
8,355,623 B2 1/2013 Vinegar et al.
8,356,935 B2 1/2013 Arora et al.
8,381,806 B2 2/2013 Menotti
8,381,815 B2 2/2013 Karanikas et al.
8,434,555 B2 5/2013 Bos et al.
8,450,540 B2 5/2013 Roes et al.
8,459,359 B2 6/2013 Vinegar
8,485,252 B2 7/2013 de Rouffignac et al.
8,485,256 B2 7/2013 Bass et al.
8,485,847 B2 7/2013 Tilley
8,502,120 B2 8/2013 Bass et al.
8,536,497 B2 9/2013 Kim
8,555,971 B2 10/2013 Vinegar et al.
8,606,091 B2 12/2013 John et al.
8,627,887 B2 1/2014 Vinegar et al.
8,631,866 B2 1/2014 Nguyen
8,636,323 B2 1/2014 Prince-Wright et al.
8,701,768 B2 4/2014 Marino et al.
8,701,769 B2 4/2014 Beer
2002/0027001 A1 3/2002 Wellington et al.
2002/0028070 A1 3/2002 Holen
2002/0033253 A1 3/2002 Rouffignac et al.
2002/0036089 A1 3/2002 Vinegar et al.
2002/0038069 A1 3/2002 Wellington et al.
2002/0040779 A1 4/2002 Wellington et al.
2002/0040780 A1 4/2002 Wellington et al.
2002/0053431 A1 5/2002 Wellington et al.
2002/0076212 A1 6/2002 Zhang et al.
2003/0066642 A1 4/2003 Wellington et al.
2003/0079877 A1 5/2003 Wellington et al.
2003/0085034 A1 5/2003 Wellington et al.
2003/0146002 A1 8/2003 Vinegar et al.
2003/0196789 A1 10/2003 Wellington et al.
2003/0201098 A1 10/2003 Karanikas et al.
2004/0163801 A1 8/2004 Dalrymple
2005/0006128 A1 1/2005 Mita et al.
2005/0269313 A1 12/2005 Vinegar
2006/0231283 A1 10/2006 Stagi et al.
2006/0289536 A1 12/2006 Vinegar et al.
2007/0127897 A1 6/2007 John et al.
2007/0173122 A1 7/2007 Matsouka
2008/0073104 A1 3/2008 Barberree et al.
2008/0135244 A1 6/2008 Miller
2009/0070997 A1 3/2009 Yavari et al.
2009/0095478 A1 4/2009 Karanikas et al.

(56) References Cited

U.S. PATENT DOCUMENTS

| | | | | |
|---|---|---|---|---|
| 2009/0095479 | A1 | 4/2009 | Karanikas et al. | |
| 2009/0120646 | A1 | 5/2009 | Kim et al. | |
| 2009/0126929 | A1 | 5/2009 | Vinegar | |
| 2009/0189617 | A1 | 7/2009 | Burns et al. | 324/649 |
| 2009/0194524 | A1 | 8/2009 | Kim et al. | |
| 2009/0200290 | A1 | 8/2009 | Cardinal et al. | |
| 2009/0321417 | A1 | 12/2009 | Burns et al. | |
| 2010/0038112 | A1 | 2/2010 | Grether | |
| 2010/0044068 | A1 | 2/2010 | Deighton et al. | |
| 2010/0044781 | A1 | 2/2010 | Tanabe | |
| 2010/0071903 | A1 | 3/2010 | Prince-Wright et al. | 166/302 |
| 2010/0089584 | A1* | 4/2010 | Burns | 166/302 |
| 2010/0096137 | A1 | 4/2010 | Nguyen et al. | 166/302 |
| 2010/0108379 | A1 | 5/2010 | Edbury et al. | |
| 2010/0147521 | A1 | 6/2010 | Xie et al. | |
| 2010/0147522 | A1 | 6/2010 | Xie et al. | |
| 2010/0155070 | A1 | 6/2010 | Roes et al. | |
| 2010/0190649 | A1 | 7/2010 | Doll et al. | |
| 2010/0224368 | A1 | 9/2010 | Mason | |
| 2010/0258265 | A1 | 10/2010 | Karanikas et al. | 165/45 |
| 2010/0258290 | A1 | 10/2010 | Bass | |
| 2010/0258291 | A1 | 10/2010 | Everett de St. Remey et al. | 166/60 |
| 2011/0042084 | A1 | 2/2011 | Bos et al. | |
| 2011/0124228 | A1 | 5/2011 | Coles et al. | 439/624 |
| 2011/0132661 | A1 | 6/2011 | Harmason et al. | |
| 2011/0134958 | A1 | 6/2011 | Aroa et al. | |
| 2011/0247805 | A1 | 10/2011 | de St. Remey et al. | |
| 2011/0247817 | A1 | 10/2011 | Bass et al. | |
| 2011/0248018 | A1 | 10/2011 | Bass et al. | |
| 2012/0084978 | A1 | 4/2012 | Hartford et al. | |
| 2012/0085564 | A1 | 4/2012 | D'Angelo III et al. | |
| 2012/0090174 | A1 | 4/2012 | Harmason et al. | 29/871 |
| 2012/0110845 | A1 | 5/2012 | Burns et al. | |
| 2012/0118634 | A1 | 5/2012 | Coles et al. | |
| 2012/0193099 | A1 | 8/2012 | Vinegar et al. | |
| 2012/0255772 | A1 | 10/2012 | D'Angelo, III et al. | |
| 2013/0086803 | A1 | 4/2013 | Noel et al. | |
| 2013/0087327 | A1 | 4/2013 | Nguyen et al. | |
| 2013/0087383 | A1 | 4/2013 | Herrera et al. | |

FOREIGN PATENT DOCUMENTS

| | | |
|---|---|---|
| CA | 1288043 | 8/1991 |
| CN | 85109010 | 6/1987 |
| EP | 107927 | 5/1984 |
| EP | 130671 | 9/1985 |
| GB | 676543 | 7/1952 |
| GB | 1010023 | 11/1965 |
| GB | 1204405 | 9/1970 |
| JP | 2000340350 | 12/2000 |
| WO | 97/23924 | 7/1997 |
| WO | 00/19061 | 4/2000 |
| WO | 2006116078 | 11/2006 |

OTHER PUBLICATIONS

U.S. Patent and Trademark Office, Office Communication for U.S. Appl. No. 13/411,300; mailed May 14, 2013.
U.S. Patent and Trademark Office, Office Communication for U.S. Appl. No. 13/268,258; mailed May 21, 2013.
U.S. Patent and Trademark Office, Office Communication for U.S. Appl. No. 12/576,772; mailed Jun. 25, 2013.
U.S. Patent and Trademark Office, Office Communication for U.S. Appl. No. 12/901,237; mailed Jun. 13, 2013.
"Mineral insulated Cable-Aeropak MI Thermocouple Cable" www.ariindustries.com/cable/aeropak.php3. first visited Feb. 6, 2005.
U.S. Patent and Trademark Office, Office Communication for U.S. Appl. No. 13/268,238; mailed May 16, 2013.
U.S. Patent and Trademark Office, Office Communication for U.S. Appl. No. 13/083,200; mailed Jul. 22, 2013.
Korean Communication for Korean Application No. 2008-7011678, mailed Jun. 24, 2013, 2 pages.
Canadian Communication for Canadian Application No. 2,606,210 mailed Feb. 25, 2013, 2 pages.
Canadian Communication for Canadian Application No. 2,626,969, mailed Dec. 19, 2012.
U.S. Patent and Trademark Office, Office Communication for U.S. Appl. No. 12/901,231; mailed Aug. 15, 2013.
Translation of Russian Communication for Russian Application No. 2010119956, mailed Apr. 19, 2013, 2 pages.
GCC Communication for GCC Patent Application No. GCC/P/2008/11972, mailed Jul. 22, 2013, 3 pages.
Korean Communication for Korean Patent Application No. 2008-7028482, mailed Sep. 24, 2013, 11 pages.
U.S. Patent and Trademark "Office Communication" for U.S. Appl. No. 13/268,226, mailed Sep. 3, 2013.
U.S. Patent and Trademark "Office Communication" for U.S. Appl. No. 13/268,246, mailed Aug. 30, 2013.
U.S. Patent and Trademark Office, Office Communication for U.S. Appl. No. 13/411,300; mailed Oct. 16, 2013.
U.S. Patent and Trademark Office, Office Communication for U.S. Appl. No. 13/738,345; mailed Oct. 16, 2013.
U.S. Patent and Trademark Office, Office Communication for U.S. Appl. No. 13/567,799; mailed Oct. 16, 2013.
U.S. Patent and Trademark Office, Office Communication for U.S. Appl. No. 13/083,177; mailed Oct. 9, 2013.
U.S. Patent and Trademark Office, Office Communication for U.S. Appl. No. 12/901,237; mailed Dec. 26, 2013.
U.S. Patent and Trademark Office, Office Communication for U.S. Appl. No. 13/960,355; mailed Dec. 3, 2013.
Korean Communication for Korean Patent Application No. 2008-7011678, mailed Dec. 31, 2013, 10 pages.
Canadian Communication for Canadian Patent Application No. 2650089, mailed Oct. 3, 2013, 3 pages.
Australian Communication for Australian Patent Application No. 2011237617, mailed Apr. 2, 2013, 4 pages.
Canadian Communication for Canadian Patent Applicatoin No. 2649394, mailed Oct. 3, 2013.
U.S. Patent and Trademark Office, Office Communication for U.S. Appl. No. 12/576,772; mailed Mar. 10, 2014.
U.S. Patent and Trademark Office, Office Communication for U.S. Appl. No. 13/083,177; mailed Mar. 13, 2014.
U.S. Patent and Trademark Office, Office Communication for U.S. Appl. No. 12/901,237; mailed Apr. 3, 2014.
U.S. Patent and Trademark Office, Office Communication for co-pending U.S. Appl. No. 12/576,772; mailed Oct. 13, 2011.
U.S. Patent and Trademark Office, Office Communication for U.S. Appl. No. 12/106,065; mailed Nov. 28, 2011.
McGee et al. "Electrical Heating with Horizontal Wells, The Heat Transfer Problem, " International Conference on Horizontal Well Tehcnology, Calgary, Alberta Canada, 1996; 14 pages.
"IEEE Recommended Practice for Electrical Impedance, Induction, and Skin Effect Heating of Pipelines and Vessels," IEEE Std. 844-200, 2000; 6 pages.
Swedish shale oil-Production methods in Sweden, Organisation for European Economic Cooperation, 1952, (70 pages).
Bosch et al. "Evaluation of Downhole Electric Impedance Heating Systems for Paraffin Control in Oil Wells," IEEE Transactions on Industrial Applications, 1992, vol. 28; pp. 190-194.
Bosch et al., "Evaluation of Downhole Electric Impedance Heating Systems for Paraffin Control in Oil Wells," Industry Applications Society 37th Annual Petroleum and Chemical Industry Conference; The Institute of Electrical and Electronics Engineers Inc., Sep. 1990, pp. 223-227.
Rangel-German et al., "Electrical-Heating-Assisted Recovery for Heavy Oil", pp. 1-43. 2004.
Kovscek, Anthony R., "Reservoir Engineering analysis of Novel Thermal Oil Recovery Techniques applicable to Alaskan North Slope Heavy Oils", pp. 1-6.
Boggs, "The Case for Frequency Domain PD Testing in the Context of Distribution Cable", Electrical Insulation Magazine, IEEE, vol. 19, Issue 4, Jul.-Aug. 2003, pp. 13-19.
U.S. Patent and Trademark Office, Office Communication for U.S. Appl. No. 11/788,869; mailed May 4, 2012.

(56) References Cited

OTHER PUBLICATIONS

U.S. Patent and Trademark Office, Office Communication for U.S. Appl. No. 12/576,772; mailed May 1, 2012.
U.S. Patent and Trademark Office, Office Communication for U.S. Appl. No. 12/106,065; mailed Jun. 27, 2012.
U.S. Patent and Trademark Office, Office Communication for U.S. Appl. No. 12/757,650; mailed Jul. 19, 2012.
U.S. Patent and Trademark Office, Office Communication for U.S. Appl. No. 12/901,237; mailed Aug. 2, 2012.
U.S. Patent and Trademark Office, Office Communication for U.S. Appl. No. 12/901,231; mailed Dec. 19, 2012.
U.S. Patent and Trademark Office, Office Communication for U.S. Appl. No. 12/106,139; mailed Jul. 21, 2010.
U.S. Patent and Trademark Office, Office Communication for U.S. Appl. No. 12/106,139; mailed Jan. 19, 2011.
U.S. Patent and Trademark Office, Office Communication for U.S. Appl. No. 12/106,139; mailed Oct. 6, 2011.
U.S. Patent and Trademark Office, Office Communication for U.S. Appl. No. 12/106,139; mailed Apr. 10, 2012.
U.S. Patent and Trademark Office, Office Communication for U.S. Appl. No. 13/083,169; mailed Sep. 11, 2012.
U.S. Patent and Trademark Office, "Office Communication," for U.S. Appl. No. 11/113,353 mailed Jul. 25, 2008.
U.S. Patent and Trademark Office, "Office Communication," for U.S. Appl. No. 11/113,353 mailed Nov. 18, 2008.
U.S. Patent and Trademark Office, "Office Communication," for U.S. Appl. No. 11/113,353 mailed Sep. 20, 2012.
U.S. Patent and Trademark Office, "Office Communication," for U.S. Appl. No. 11/584,801 mailed Oct. 27, 2009.
U.S. Patent and Trademark Office, "Office Communication," for U.S. Appl. No. 11,584,801 mailed Aug. 11, 2008.
U.S. Patent and Trademark Office, "Office Communication," for U.S. Appl. No. 11/584,801 mailed Jan. 11, 2008; 7 pages.
U.S. Patent and Trademark Office, Office Communication for U.S. Appl. No. 12/250,346; mailed Sep. 5, 2012.

* cited by examiner

INTEGRAL SPLICE FOR INSULATED CONDUCTORS

PRIORITY CLAIM

This patent claims priority to U.S. Provisional Patent Application No. 61/544,804 to Herrera et al., entitled "INTEGRAL SPLICE FOR INSULATED CONDUCTORS", filed Oct. 7, 2011, which is incorporated by reference in its entirety.

RELATED PATENTS

This patent application incorporates by reference in its entirety each of U.S. Pat. No. 6,688,387 to Wellington et al.; U.S. Pat. No. 6,991,036 to Sumnu-Dindoruk et al.; U.S. Pat. No. 6,698,515 to Karanikas et al.; U.S. Pat. No. 6,880,633 to Wellington et al.; U.S. Pat. No. 6,782,947 to de Rouffignac et al.; U.S. Pat. No. 6,991,045 to Vinegar et al.; U.S. Pat. No. 7,073,578 to Vinegar et al.; U.S. Pat. No. 7,121,342 to Vinegar et al.; U.S. Pat. No. 7,320,364 to Fairbanks; U.S. Pat. No. 7,527,094 to McKinzie et al.; U.S. Pat. No. 7,584,789 to Mo et al.; U.S. Pat. No. 7,533,719 to Hinson et al.; U.S. Pat. No. 7,562,707 to Miller; and U.S. Pat. No. 7,798,220 to Vinegar et al.; U.S. Patent Application Publication Nos. 2009-0189617 to Burns et al.; 2010-0071903 to Prince-Wright et al.; 2010-0096137 to Nguyen et al.; 2010-0258265 to Karanikas et al.; 2011-0124228 to Coles et al.; 2012-0090174 to Coles et al.; and U.S. patent application Ser. No. 13/441,172 filed Apr. 6, 2012.

BACKGROUND

1. Field of the Invention

The present invention relates to systems for insulated conductors used in heater elements. More particularly, the invention relates to fittings to splice together insulated conductor cables and/or lead-in cables.

2. Description of Related Art

Hydrocarbons obtained from subterranean formations are often used as energy resources, as feedstocks, and as consumer products. Concerns over depletion of available hydrocarbon resources and concerns over declining overall quality of produced hydrocarbons have led to development of processes for more efficient recovery, processing and/or use of available hydrocarbon resources. In situ processes may be used to remove hydrocarbon materials from subterranean formations that were previously inaccessible and/or too expensive to extract using available methods. Chemical and/or physical properties of hydrocarbon material in a subterranean formation may need to be changed to allow hydrocarbon material to be more easily removed from the subterranean formation and/or increase the value of the hydrocarbon material. The chemical and physical changes may include in situ reactions that produce removable fluids, composition changes, solubility changes, density changes, phase changes, and/or viscosity changes of the hydrocarbon material in the formation.

Heaters may be placed in wellbores to heat a formation during an in situ process. There are many different types of heaters which may be used to heat the formation. Examples of in situ processes utilizing downhole heaters are illustrated in U.S. Pat. No. 2,634,961 to Ljungstrom; U.S. Pat. No. 2,732,195 to Ljungstrom; U.S. Pat. No. 2,780,450 to Ljungstrom; 2,789,805 to Ljungstrom; U.S. Pat. No. 2,923,535 to Ljungstrom; U.S. Pat. No. 4,886,118 to Van Meurs et al.; and U.S. Pat. No. 6,688,387 to Wellington et al.; each of which is incorporated by reference as if fully set forth herein.

Mineral insulated (MI) cables (insulated conductors) for use in subsurface applications, such as heating hydrocarbon containing formations in some applications, are longer, may have larger outside diameters, and may operate at higher voltages and temperatures than what is typical in the MI cable industry. There are many potential problems during manufacture and/or assembly of long length insulated conductors.

For example, there are potential electrical and/or mechanical problems due to degradation over time of the electrical insulator used in the insulated conductor. There are also potential problems with electrical insulators to overcome during assembly of the insulated conductor heater. Problems such as core bulge or other mechanical defects may occur during assembly of the insulated conductor heater. Such occurrences may lead to electrical problems during use of the heater and may potentially render the heater inoperable for its intended purpose.

In addition, for subsurface applications, the joining of multiple MI cables may be needed to make MI cables with sufficient length to reach the depths and distances needed to heat the subsurface efficiently and to join segments with different functions, such as lead-in cables joined to heater sections. Such long heaters also require higher voltages to provide enough power to the farthest ends of the heaters.

Conventional MI cable splice designs are typically not suitable for voltages above 1000 volts, above 1500 volts, or above 2000 volts and may not operate for extended periods without failure at elevated temperatures, such as over 650° C. (about 1200° F.), over 700° C. (about 1290° F.), or over 800° C. (about 1470° F.). Such high voltage, high temperature applications typically require the compaction of the mineral insulant in the splice to be as close as possible to or above the level of compaction in the insulated conductor (MI cable) itself.

The relatively large outside diameter and long length of MI cables for some applications requires that the cables be spliced while oriented horizontally. There are splices for other applications of MI cables that have been fabricated horizontally. These techniques typically use a small hole through which the mineral insulation (such as magnesium oxide powder) is filled into the splice and compacted slightly through vibration and tamping. Such methods do not provide sufficient compaction of the mineral insulation or even allow any compaction of the mineral insulation, and are not suitable for making splices for use at the high voltages needed for these subsurface applications.

Thus, there is a need for splices of insulated conductors that are simple yet can operate at the high voltages and temperatures in the subsurface environment over long durations without failure. In addition, the splices may need higher bending and tensile strengths to inhibit failure of the splice under the weight loads and temperatures that the cables can be subjected to in the subsurface. Techniques and methods also may be utilized to reduce electric field intensities in the splices so that leakage currents in the splices are reduced and to increase the margin between the operating voltage and electrical breakdown. Reducing electric field intensities may help increase voltage and temperature operating ranges of the splices.

In addition, there may be problems with increased stress on the insulated conductors during assembly and/or installation into the subsurface of the insulated conductors. For example, winding and unwinding of the insulated conductors on spools used for transport and installation of the insulated conductors may lead to mechanical stress on the electrical insulators and/or other components in the insulated conductors. Thus, more reliable systems and methods are needed to reduce or eliminate potential problems during manufacture, assembly, and/or installation of insulated conductors.

SUMMARY

Embodiments described herein generally relate to systems, methods, and heaters for treating a subsurface formation. Embodiments described herein also generally relate to heaters that have novel components therein. Such heaters can be obtained by using the systems and methods described herein.

In certain embodiments, the invention provides one or more systems, methods, and/or heaters. In some embodiments, the systems, methods, and/or heaters are used for treating a subsurface formation.

In certain embodiments, a method for coupling a heating section and an overburden section of an insulated conductor heater, includes: coupling a core of the heating section to a core of the overburden section, wherein a diameter of the core of the heating section is less than a diameter of the core of the overburden section; placing a first insulation layer over the core of the heating section such that at least part of an end portion of the core of the heating section is exposed; placing a second insulation layer over the core of the overburden section such that the second insulation layer extends over the exposed portion of the core of the heating section, wherein a thickness of the second insulation layer is less than a thickness of the first insulation layer and an outer diameter of the overburden section is substantially the same as an outer diameter of the heating section; and placing an outer electrical conductor around the heating section and the overburden section.

In certain embodiments, a method for coupling a heating section and an overburden section of an insulated conductor heater includes: coupling a core of the heating section to a core of a first transition section, wherein a diameter of the first transition section core is substantially the same as a diameter of the heating section core; coupling the first transition section core to a core of a second transition section, wherein a diameter of the second transition section core tapers from substantially the same diameter as the first transition section core at the coupling between the first transition section core and the second transition section core to a larger diameter along a length of the second transition section core; coupling the second transition section core to a core of the overburden section, wherein a diameter of the overburden section core is substantially the same as the larger diameter of the second transition section core; placing a first insulation layer over the heating section core and at least part of the first transition section core; placing a second insulation layer over the overburden section core and at least part of the second transition section core, wherein a thickness of the second insulation layer is less than a thickness of the first insulation layer; and placing an outer electrical conductor around the first insulation layer and the second insulation layer, wherein outer diameters of the heating section, the first transition section, the second transition section, and the overburden section are substantially the same along a length of the insulated conductor heater.

In certain embodiments, a coupling between a heating section and an overburden section of an insulated conductor heater includes: a first transition section comprising a core with a diameter substantially the same as a diameter of a core of the heating section; a second transition section comprising a core coupled to the first transition section core, wherein a diameter of the second transition section core tapers from substantially the same diameter as the first transition section core at the coupling between the first transition section core and the second transition section core to a larger diameter along a length of the second transition section core, and wherein a diameter of the overburden section core is substantially the same as the larger diameter of the second transition section core; a first insulation layer placed over the heating section core and at least part of the first transition section core; a second insulation layer placed over the overburden section core and at least part of the second transition section core, wherein a thickness of the second insulation layer is less than a thickness of the first insulation layer; and an outer electrical conductor placed around the first insulation layer and the second insulation layer, wherein outer diameters of the heating section, the first transition section, the second transition section, and the overburden section are substantially the same along a length of the insulated conductor heater.

In further embodiments, features from specific embodiments may be combined with features from other embodiments. For example, features from one embodiment may be combined with features from any of the other embodiments.

In further embodiments, treating a subsurface formation is performed using any of the methods, systems, power supplies, or heaters described herein.

In further embodiments, additional features may be added to the specific embodiments described herein.

BRIEF DESCRIPTION OF THE DRAWINGS

Features and advantages of the methods and apparatus of the present invention will be more fully appreciated by reference to the following detailed description of presently preferred but nonetheless illustrative embodiments in accordance with the present invention when taken in conjunction with the accompanying drawings.

Figure 1:
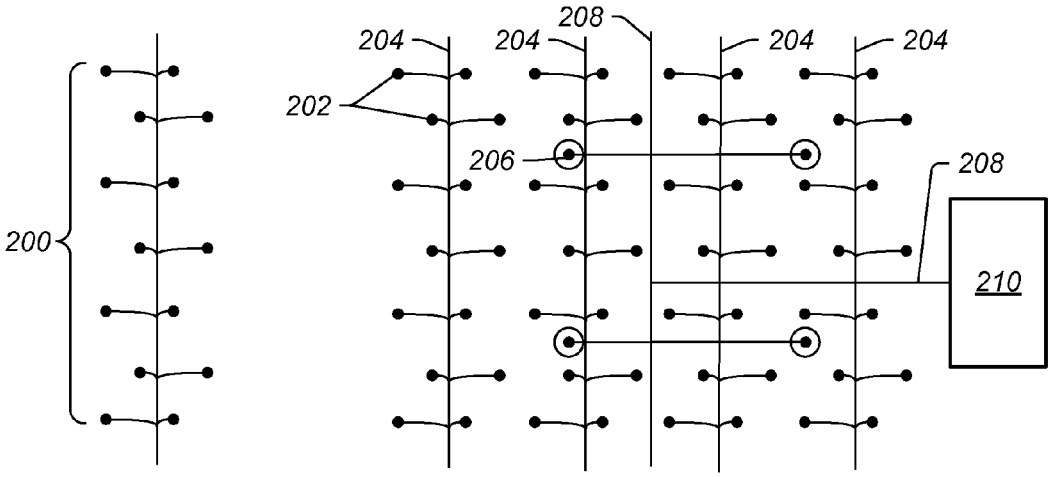
FIG. 1 shows a schematic view of an embodiment of a portion of an in situ heat treatment system for treating a hydrocarbon containing formation.

While the invention is susceptible to various modifications and alternative forms, specific embodiments thereof are shown by way of example in the drawings and will herein be described in detail. The drawings may not be to scale. It should be understood that the drawings and detailed description thereto are not intended to limit the invention to the particular form disclosed, but to the contrary, the intention is to cover all modifications, equivalents and alternatives falling within the spirit and scope of the present invention as defined by the appended claims.

DETAILED DESCRIPTION

The following description generally relates to systems and methods for treating hydrocarbons in the formations. Such formations may be treated to yield hydrocarbon products, hydrogen, and other products.

"Alternating current (AC)" refers to a time-varying current that reverses direction substantially sinusoidally. AC produces skin effect electricity flow in a ferromagnetic conductor.

"Coupled" means either a direct connection or an indirect connection (for example, one or more intervening connections) between one or more objects or components. The phrase "directly connected" means a direct connection between objects or components such that the objects or components are connected directly to each other so that the objects or components operate in a "point of use" manner.

A "formation" includes one or more hydrocarbon containing layers, one or more non-hydrocarbon layers, an overburden, and/or an underburden. "Hydrocarbon layers" refer to layers in the formation that contain hydrocarbons. The hydrocarbon layers may contain non-hydrocarbon material and hydrocarbon material. The "overburden" and/or the "underburden" include one or more different types of impermeable materials. For example, the overburden and/or underburden may include rock, shale, mudstone, or wet/tight carbonate. In some embodiments of in situ heat treatment processes, the overburden and/or the underburden may include a hydrocarbon containing layer or hydrocarbon containing layers that are relatively impermeable and are not subjected to temperatures during in situ heat treatment processing that result in significant characteristic changes of the hydrocarbon containing layers of the overburden and/or the underburden. For example, the underburden may contain shale or mudstone, but the underburden is not allowed to heat to pyrolysis temperatures during the in situ heat treatment process. In some cases, the overburden and/or the underburden may be somewhat permeable.

"Formation fluids" refer to fluids present in a formation and may include pyrolyzation fluid, synthesis gas, mobilized hydrocarbons, and water (steam). Formation fluids may include hydrocarbon fluids as well as non-hydrocarbon fluids. The term "mobilized fluid" refers to fluids in a hydrocarbon containing formation that are able to flow as a result of thermal treatment of the formation. "Produced fluids" refer to fluids removed from the formation.

A "heat source" is any system for providing heat to at least a portion of a formation substantially by conductive and/or radiative heat transfer. For example, a heat source may include electrically conducting materials and/or electric heaters such as an insulated conductor, an elongated member, and/or a conductor disposed in a conduit. A heat source may also include systems that generate heat by burning a fuel external to or in a formation. The systems may be surface burners, downhole gas burners, flameless distributed combustors, and natural distributed combustors. In some embodiments, heat provided to or generated in one or more heat sources may be supplied by other sources of energy. The other sources of energy may directly heat a formation, or the energy may be applied to a transfer medium that directly or indirectly heats the formation. It is to be understood that one or more heat sources that are applying heat to a formation may use different sources of energy. Thus, for example, for a given formation some heat sources may supply heat from electrically conducting materials, electric resistance heaters, some heat sources may provide heat from combustion, and some heat sources may provide heat from one or more other energy sources (for example, chemical reactions, solar energy, wind energy, biomass, or other sources of renewable energy). A chemical reaction may include an exothermic reaction (for example, an oxidation reaction). A heat source may also include an electrically conducting material and/or a heater that provides heat to a zone proximate and/or surrounding a heating location such as a heater well.

A "heater" is any system or heat source for generating heat in a well or a near wellbore region. Heaters may be, but are not limited to, electric heaters, burners, combustors that react with material in or produced from a formation, and/or combinations thereof.

"Hydrocarbons" are generally defined as molecules formed primarily by carbon and hydrogen atoms. Hydrocarbons may also include other elements such as, but not limited to, halogens, metallic elements, nitrogen, oxygen, and/or sulfur. Hydrocarbons may be, but are not limited to, kerogen, bitumen, pyrobitumen, oils, natural mineral waxes, and asphaltites. Hydrocarbons may be located in or adjacent to mineral matrices in the earth. Matrices may include, but are not limited to, sedimentary rock, sands, silicilytes, carbonates, diatomites, and other porous media. "Hydrocarbon fluids" are fluids that include hydrocarbons. Hydrocarbon fluids may include, entrain, or be entrained in non-hydrocarbon fluids such as hydrogen, nitrogen, carbon monoxide, carbon dioxide, hydrogen sulfide, water, and ammonia.

An "in situ conversion process" refers to a process of heating a hydrocarbon containing formation from heat sources to raise the temperature of at least a portion of the formation above a pyrolysis temperature so that pyrolyzation fluid is produced in the formation.

An "in situ heat treatment process" refers to a process of heating a hydrocarbon containing formation with heat sources to raise the temperature of at least a portion of the formation above a temperature that results in mobilized fluid, visbreaking, and/or pyrolysis of hydrocarbon containing material so that mobilized fluids, visbroken fluids, and/or pyrolyzation fluids are produced in the formation.

"Insulated conductor" refers to any elongated material that is able to conduct electricity and that is covered, in whole or in part, by an electrically insulating material.

"Nitride" refers to a compound of nitrogen and one or more other elements of the Periodic Table. Nitrides include, but are not limited to, silicon nitride, boron nitride, or alumina nitride.

"Perforations" include openings, slits, apertures, or holes in a wall of a conduit, tubular, pipe or other flow pathway that allow flow into or out of the conduit, tubular, pipe or other flow pathway.

"Pyrolysis" is the breaking of chemical bonds due to the application of heat. For example, pyrolysis may include transforming a compound into one or more other substances by heat alone. Heat may be transferred to a section of the formation to cause pyrolysis.

"Pyrolyzation fluids" or "pyrolysis products" refers to fluid produced substantially during pyrolysis of hydrocarbons. Fluid produced by pyrolysis reactions may mix with other fluids in a formation. The mixture would be considered pyrolyzation fluid or pyrolyzation product. As used herein, "pyrolysis zone" refers to a volume of a formation (for example, a relatively permeable formation such as a tar sands formation) that is reacted or reacting to form a pyrolyzation fluid.

"Thickness" of a layer refers to the thickness of a cross section of the layer, wherein the cross section is normal to a face of the layer.

The term "wellbore" refers to a hole in a formation made by drilling or insertion of a conduit into the formation. A wellbore may have a substantially circular cross section, or another cross-sectional shape. As used herein, the terms "well" and "opening," when referring to an opening in the formation may be used interchangeably with the term "wellbore."

A formation may be treated in various ways to produce many different products. Different stages or processes may be used to treat the formation during an in situ heat treatment process. In some embodiments, one or more sections of the formation are solution mined to remove soluble minerals from the sections. Solution mining minerals may be performed before, during, and/or after the in situ heat treatment process. In some embodiments, the average temperature of one or more sections being solution mined may be maintained below about 120° C.

In some embodiments, one or more sections of the formation are heated to remove water from the sections and/or to remove methane and other volatile hydrocarbons from the sections. In some embodiments, the average temperature may be raised from ambient temperature to temperatures below about 220° C. during removal of water and volatile hydrocarbons.

In some embodiments, one or more sections of the formation are heated to temperatures that allow for movement and/or visbreaking of hydrocarbons in the formation. In some embodiments, the average temperature of one or more sections of the formation are raised to mobilization temperatures of hydrocarbons in the sections (for example, to temperatures ranging from 100° C. to 250° C., from 120° C. to 240° C., or from 150° C. to 230° C.).

In some embodiments, one or more sections are heated to temperatures that allow for pyrolysis reactions in the formation. In some embodiments, the average temperature of one or more sections of the formation may be raised to pyrolysis temperatures of hydrocarbons in the sections (for example, temperatures ranging from 230° C. to 900° C., from 240° C. to 400° C. or from 250° C. to 350° C.).

Heating the hydrocarbon containing formation with a plurality of heat sources may establish thermal gradients around the heat sources that raise the temperature of hydrocarbons in the formation to desired temperatures at desired heating rates. The rate of temperature increase through the mobilization temperature range and/or the pyrolysis temperature range for desired products may affect the quality and quantity of the formation fluids produced from the hydrocarbon containing formation. Slowly raising the temperature of the formation through the mobilization temperature range and/or pyrolysis temperature range may allow for the production of high quality, high API gravity hydrocarbons from the formation. Slowly raising the temperature of the formation through the mobilization temperature range and/or pyrolysis temperature range may allow for the removal of a large amount of the hydrocarbons present in the formation as hydrocarbon product.

In some in situ heat treatment embodiments, a portion of the formation is heated to a desired temperature instead of slowly heating the temperature through a temperature range. In some embodiments, the desired temperature is 300° C., 325° C., or 350° C. Other temperatures may be selected as the desired temperature.

Superposition of heat from heat sources allows the desired temperature to be relatively quickly and efficiently established in the formation. Energy input into the formation from the heat sources may be adjusted to maintain the temperature in the formation substantially at a desired temperature.

Mobilization and/or pyrolysis products may be produced from the formation through production wells. In some embodiments, the average temperature of one or more sections is raised to mobilization temperatures and hydrocarbons are produced from the production wells. The average temperature of one or more of the sections may be raised to pyrolysis temperatures after production due to mobilization decreases below a selected value. In some embodiments, the average temperature of one or more sections may be raised to pyrolysis temperatures without significant production before reaching pyrolysis temperatures. Formation fluids including pyrolysis products may be produced through the production wells.

In some embodiments, the average temperature of one or more sections may be raised to temperatures sufficient to allow synthesis gas production after mobilization and/or pyrolysis. In some embodiments, hydrocarbons may be raised to temperatures sufficient to allow synthesis gas production without significant production before reaching the temperatures sufficient to allow synthesis gas production. For example, synthesis gas may be produced in a temperature range from about 400° C. to about 1200° C., about 500° C. to about 1100° C., or about 550° C. to about 1000° C. A synthesis gas generating fluid (for example, steam and/or water) may be introduced into the sections to generate synthesis gas. Synthesis gas may be produced from production wells.

Solution mining, removal of volatile hydrocarbons and water, mobilizing hydrocarbons, pyrolyzing hydrocarbons, generating synthesis gas, and/or other processes may be performed during the in situ heat treatment process. In some embodiments, some processes may be performed after the in situ heat treatment process. Such processes may include, but are not limited to, recovering heat from treated sections, storing fluids (for example, water and/or hydrocarbons) in previously treated sections, and/or sequestering carbon dioxide in previously treated sections.

FIG. 1 depicts a schematic view of an embodiment of a portion of the in situ heat treatment system for treating the hydrocarbon containing formation. The in situ heat treatment system may include barrier wells 200. Barrier wells are used to form a barrier around a treatment area. The barrier inhibits fluid flow into and/or out of the treatment area. Barrier wells include, but are not limited to, dewatering wells, vacuum wells, capture wells, injection wells, grout wells, freeze wells, or combinations thereof. In some embodiments, barrier wells 200 are dewatering wells. Dewatering wells may remove liquid water and/or inhibit liquid water from entering a portion of the formation to be heated, or to the formation being heated. In the embodiment depicted in FIG. 1, the barrier wells 200 are shown extending only along one side of heat sources 202, but the barrier wells typically encircle all heat sources 202 used, or to be used, to heat a treatment area of the formation.

Heat sources 202 are placed in at least a portion of the formation. Heat sources 202 may include heaters such as insulated conductors, conductor-in-conduit heaters, surface burners, flameless distributed combustors, and/or natural distributed combustors. Heat sources 202 may also include other types of heaters. Heat sources 202 provide heat to at least a portion of the formation to heat hydrocarbons in the formation. Energy may be supplied to heat sources 202 through supply lines 204. Supply lines 204 may be structurally different depending on the type of heat source or heat sources used to heat the formation. Supply lines 204 for heat sources may transmit electricity for electric heaters, may transport fuel for combustors, or may transport heat exchange fluid that is circulated in the formation. In some embodiments, electricity for an in situ heat treatment process may be provided by a nuclear power plant or nuclear power plants. The use of nuclear power may allow for reduction or elimination of carbon dioxide emissions from the in situ heat treatment process.

When the formation is heated, the heat input into the formation may cause expansion of the formation and geomechanical motion. The heat sources may be turned on before, at the same time, or during a dewatering process. Computer simulations may model formation response to heating. The computer simulations may be used to develop a pattern and time sequence for activating heat sources in the formation so that geomechanical motion of the formation does not adversely affect the functionality of heat sources, production wells, and other equipment in the formation.

Heating the formation may cause an increase in permeability and/or porosity of the formation. Increases in permeability and/or porosity may result from a reduction of mass in the formation due to vaporization and removal of water, removal of hydrocarbons, and/or creation of fractures. Fluid may flow more easily in the heated portion of the formation because of the increased permeability and/or porosity of the formation. Fluid in the heated portion of the formation may move a considerable distance through the formation because of the increased permeability and/or porosity. The considerable distance may be over 1000 m depending on various factors, such as permeability of the formation, properties of the fluid, temperature of the formation, and pressure gradient allowing movement of the fluid. The ability of fluid to travel considerable distance in the formation allows production wells 206 to be spaced relatively far apart in the formation.

Production wells 206 are used to remove formation fluid from the formation. In some embodiments, production well 206 includes a heat source. The heat source in the production well may heat one or more portions of the formation at or near the production well. In some in situ heat treatment process embodiments, the amount of heat supplied to the formation from the production well per meter of the production well is less than the amount of heat applied to the formation from a heat source that heats the formation per meter of the heat source. Heat applied to the formation from the production well may increase formation permeability adjacent to the production well by vaporizing and removing liquid phase fluid adjacent to the production well and/or by increasing the permeability of the formation adjacent to the production well by formation of macro and/or micro fractures.

More than one heat source may be positioned in the production well. A heat source in a lower portion of the production well may be turned off when superposition of heat from adjacent heat sources heats the formation sufficiently to counteract benefits provided by heating the formation with the production well. In some embodiments, the heat source in an upper portion of the production well may remain on after the heat source in the lower portion of the production well is deactivated. The heat source in the upper portion of the well may inhibit condensation and reflux of formation fluid.

In some embodiments, the heat source in production well 206 allows for vapor phase removal of formation fluids from the formation. Providing heating at or through the production well may: (1) inhibit condensation and/or refluxing of production fluid when such production fluid is moving in the production well proximate the overburden, (2) increase heat input into the formation, (3) increase production rate from the production well as compared to a production well without a heat source, (4) inhibit condensation of high carbon number compounds (C6 hydrocarbons and above) in the production well, and/or (5) increase formation permeability at or proximate the production well.

Subsurface pressure in the formation may correspond to the fluid pressure generated in the formation. As temperatures in the heated portion of the formation increase, the pressure in the heated portion may increase as a result of thermal expansion of in situ fluids, increased fluid generation and vaporization of water. Controlling rate of fluid removal from the formation may allow for control of pressure in the formation. Pressure in the formation may be determined at a number of different locations, such as near or at production wells, near or at heat sources, or at monitor wells.

In some hydrocarbon containing formations, production of hydrocarbons from the formation is inhibited until at least some hydrocarbons in the formation have been mobilized and/or pyrolyzed. Formation fluid may be produced from the formation when the formation fluid is of a selected quality. In some embodiments, the selected quality includes an API gravity of at least about 20°, 30°, or 40°. Inhibiting production until at least some hydrocarbons are mobilized and/or pyrolyzed may increase conversion of heavy hydrocarbons to light hydrocarbons. Inhibiting initial production may minimize the production of heavy hydrocarbons from the formation. Production of substantial amounts of heavy hydrocarbons may require expensive equipment and/or reduce the life of production equipment.

In some hydrocarbon containing formations, hydrocarbons in the formation may be heated to mobilization and/or pyrolysis temperatures before substantial permeability has been generated in the heated portion of the formation. An initial lack of permeability may inhibit the transport of generated fluids to production wells 206. During initial heating, fluid pressure in the formation may increase proximate heat sources 202. The increased fluid pressure may be released, monitored, altered, and/or controlled through one or more heat sources 202. For example, selected heat sources 202 or separate pressure relief wells may include pressure relief valves that allow for removal of some fluid from the formation.

In some embodiments, pressure generated by expansion of mobilized fluids, pyrolysis fluids or other fluids generated in the formation may be allowed to increase although an open path to production wells 206 or any other pressure sink may not yet exist in the formation. The fluid pressure may be allowed to increase towards a lithostatic pressure. Fractures in the hydrocarbon containing formation may form when the fluid approaches the lithostatic pressure. For example, fractures may form from heat sources 202 to production wells 206 in the heated portion of the formation. The generation of fractures in the heated portion may relieve some of the pressure in the portion. Pressure in the formation may have to be maintained below a selected pressure to inhibit unwanted production, fracturing of the overburden or underburden, and/or coking of hydrocarbons in the formation.

After mobilization and/or pyrolysis temperatures are reached and production from the formation is allowed, pressure in the formation may be varied to alter and/or control a composition of formation fluid produced, to control a percentage of condensable fluid as compared to non-condensable fluid in the formation fluid, and/or to control an API gravity of formation fluid being produced. For example, decreasing pressure may result in production of a larger condensable fluid component. The condensable fluid component may contain a larger percentage of olefins.

In some in situ heat treatment process embodiments, pressure in the formation may be maintained high enough to promote production of formation fluid with an API gravity of greater than 20°. Maintaining increased pressure in the formation may inhibit formation subsidence during in situ heat treatment. Maintaining increased pressure may reduce or eliminate the need to compress formation fluids at the surface to transport the fluids in collection conduits to treatment facilities.

Maintaining increased pressure in a heated portion of the formation may surprisingly allow for production of large quantities of hydrocarbons of increased quality and of relatively low molecular weight. Pressure may be maintained so that formation fluid produced has a minimal amount of compounds above a selected carbon number. The selected carbon number may be at most 25, at most 20, at most 12, or at most 8. Some high carbon number compounds may be entrained in vapor in the formation and may be removed from the formation with the vapor. Maintaining increased pressure in the formation may inhibit entrainment of high carbon number compounds and/or multi-ring hydrocarbon compounds in the vapor. High carbon number compounds and/or multi-ring hydrocarbon compounds may remain in a liquid phase in the formation for significant time periods. The significant time periods may provide sufficient time for the compounds to pyrolyze to form lower carbon number compounds.

Generation of relatively low molecular weight hydrocarbons is believed to be due, in part, to autogenous generation and reaction of hydrogen in a portion of the hydrocarbon containing formation. For example, maintaining an increased pressure may force hydrogen generated during pyrolysis into the liquid phase within the formation. Heating the portion to a temperature in a pyrolysis temperature range may pyrolyze hydrocarbons in the formation to generate liquid phase pyrolyzation fluids. The generated liquid phase pyrolyzation fluids components may include double bonds and/or radicals. Hydrogen ($H_2$) in the liquid phase may reduce double bonds of the generated pyrolyzation fluids, thereby reducing a potential for polymerization or formation of long chain compounds from the generated pyrolyzation fluids. In addition, $H_2$ may also neutralize radicals in the generated pyrolyzation fluids. $H_2$ in the liquid phase may inhibit the generated pyrolyzation fluids from reacting with each other and/or with other compounds in the formation.

Formation fluid produced from production wells 206 may be transported through collection piping 208 to treatment facilities 210. Formation fluids may also be produced from heat sources 202. For example, fluid may be produced from heat sources 202 to control pressure in the formation adjacent to the heat sources. Fluid produced from heat sources 202 may be transported through tubing or piping to collection piping 208 or the produced fluid may be transported through tubing or piping directly to treatment facilities 210. Treatment facilities 210 may include separation units, reaction units, upgrading units, fuel cells, turbines, storage vessels, and/or other systems and units for processing produced formation fluids. The treatment facilities may form transportation fuel from at least a portion of the hydrocarbons produced from the formation. In some embodiments, the transportation fuel may be jet fuel, such as JP-8.

An insulated conductor may be used as an electric heater element of a heater or a heat source. The insulated conductor may include an inner electrical conductor (core) surrounded by an electrical insulator and an outer electrical conductor (jacket). The electrical insulator may include mineral insulation (for example, magnesium oxide) or other electrical insulation.

In certain embodiments, the insulated conductor is placed in an opening in a hydrocarbon containing formation. In some embodiments, the insulated conductor is placed in an uncased opening in the hydrocarbon containing formation. Placing the insulated conductor in an uncased opening in the hydrocarbon containing formation may allow heat transfer from the insulated conductor to the formation by radiation as well as conduction. Using an uncased opening may facilitate retrieval of the insulated conductor from the well, if necessary.

In some embodiments, an insulated conductor is placed within a casing in the formation; may be cemented within the formation; or may be packed in an opening with sand, gravel, or other fill material. The insulated conductor may be supported on a support member positioned within the opening. The support member may be a cable, rod, or a conduit (for example, a pipe). The support member may be made of a metal, ceramic, inorganic material, or combinations thereof. Because portions of a support member may be exposed to formation fluids and heat during use, the support member may be chemically resistant and/or thermally resistant.

Ties, spot welds, and/or other types of connectors may be used to couple the insulated conductor to the support member at various locations along a length of the insulated conductor. The support member may be attached to a wellhead at an upper surface of the formation. In some embodiments, the insulated conductor has sufficient structural strength such that a support member is not needed. The insulated conductor may, in many instances, have at least some flexibility to inhibit thermal expansion damage when undergoing temperature changes.

In certain embodiments, insulated conductors are placed in wellbores without support members and/or centralizers. An insulated conductor without support members and/or centralizers may have a suitable combination of temperature and corrosion resistance, creep strength, length, thickness (diameter), and metallurgy that will inhibit failure of the insulated conductor during use.

Figure 2:
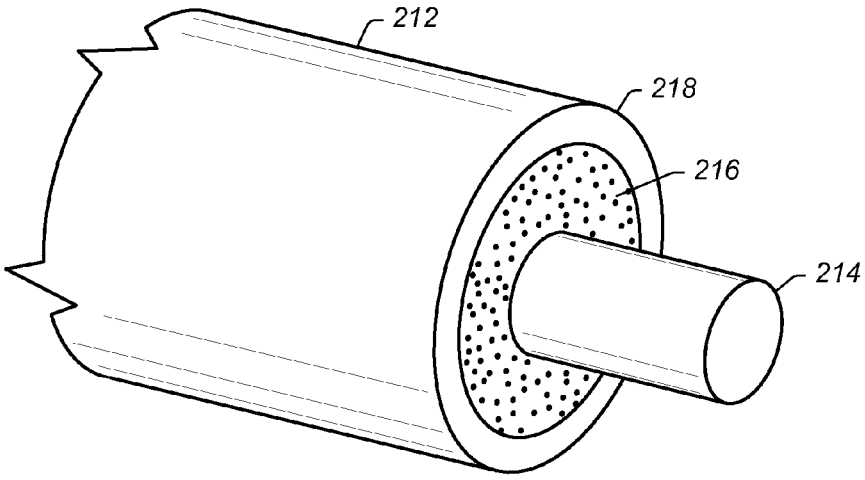
FIG. 2 depicts an embodiment of an insulated conductor heat source.

FIG. 2 depicts a perspective view of an end portion of an embodiment of insulated conductor 212. Insulated conductor 212 may have any desired cross-sectional shape such as, but not limited to, round (depicted in FIG. 2), triangular, ellipsoidal, rectangular, hexagonal, or irregular. In certain embodiments, insulated conductor 212 includes core 214, electrical insulator 216, and jacket 218. Core 214 may resistively heat when an electrical current passes through the core. Alternating or time-varying current and/or direct current may be used to provide power to core 214 such that the core resistively heats.

In some embodiments, electrical insulator 216 inhibits current leakage and arcing to jacket 218. Electrical insulator 216 may thermally conduct heat generated in core 214 to jacket 218. Jacket 218 may radiate or conduct heat to the formation. In certain embodiments, insulated conductor 212 is 1000 m or more in length. Longer or shorter insulated conductors may also be used to meet specific application needs. The dimensions of core 214, electrical insulator 216, and jacket 218 of insulated conductor 212 may be selected such that the insulated conductor has enough strength to be self supporting even at upper working temperature limits. Such insulated conductors may be suspended from wellheads or supports positioned near an interface between an overburden and a hydrocarbon containing formation without the need for support members extending into the hydrocarbon containing formation along with the insulated conductors.

Insulated conductor 212 may be designed to operate at power levels of up to about 1650 watts/meter or higher. In certain embodiments, insulated conductor 212 operates at a power level between about 500 watts/meter and about 1150 watts/meter when heating a formation. Insulated conductor 212 may be designed so that a maximum voltage level at a typical operating temperature does not cause substantial thermal and/or electrical breakdown of electrical insulator 216. Insulated conductor 212 may be designed such that jacket 218 does not exceed a temperature that will result in a significant reduction in corrosion resistance properties of the jacket material. In certain embodiments, insulated conductor 212 may be designed to reach temperatures within a range between about 650° C. and about 900° C. Insulated conductors having other operating ranges may be formed to meet specific operational requirements.

FIG. 2 depicts insulated conductor 212 having a single core 214. In some embodiments, insulated conductor 212 has two or more cores 214. For example, a single insulated conductor may have three cores. Core 214 may be made of metal or another electrically conductive material. The material used to form core 214 may include, but not be limited to, nichrome, copper, nickel, carbon steel, stainless steel, and combinations thereof. In certain embodiments, core 214 is chosen to have a diameter and a resistivity at operating temperatures such that its resistance, as derived from Ohm's law, makes it electrically and structurally stable for the chosen power dissipation per meter, the length of the heater, and/or the maximum voltage allowed for the core material.

In some embodiments, core 214 is made of different materials along a length of insulated conductor 212. For example, a first section of core 214 may be made of a material that has a significantly lower resistance than a second section of the core. The first section may be placed adjacent to a formation layer that does not need to be heated to as high a temperature as a second formation layer that is adjacent to the second section. The resistivity of various sections of core 214 may be adjusted by having a variable diameter and/or by having core sections made of different materials.

Electrical insulator 216 may be made of a variety of materials. Commonly used powders may include, but are not limited to, MgO, $Al_2O_3$, BN, $Si_3N_4$, Zirconia, BeO, different chemical variations of Spinels, and combinations thereof. MgO may provide good thermal conductivity and electrical insulation properties. The desired electrical insulation properties include low leakage current and high dielectric strength. A low leakage current decreases the possibility of thermal breakdown and the high dielectric strength decreases the possibility of arcing across the insulator. Thermal breakdown can occur if the leakage current causes a progressive rise in the temperature of the insulator leading also to arcing across the insulator.

Jacket 218 may be an outer metallic layer or electrically conductive layer. Jacket 218 may be in contact with hot formation fluids. Jacket 218 may be made of material having a high resistance to corrosion at elevated temperatures. Alloys that may be used in a desired operating temperature range of jacket 218 include, but are not limited to, 304 stainless steel, 310 stainless steel, Incoloy® 800, and Inconel® 600 (Inco Alloys International, Huntington, W. Va., U.S.A.). The thickness of jacket 218 may have to be sufficient to last for three to ten years in a hot and corrosive environment. A thickness of jacket 218 may generally vary between about 1 mm and about 2.5 mm. For example, a 1.3 mm thick, 310 stainless steel outer layer may be used as jacket 218 to provide good chemical resistance to sulfidation corrosion in a heated zone of a formation for a period of over 3 years. Larger or smaller jacket thicknesses may be used to meet specific application requirements.

One or more insulated conductors may be placed within an opening in a formation to form a heat source or heat sources. Electrical current may be passed through each insulated conductor in the opening to heat the formation. Alternatively, electrical current may be passed through selected insulated conductors in an opening. The unused conductors may be used as backup heaters. Insulated conductors may be electrically coupled to a power source in any convenient manner. Each end of an insulated conductor may be coupled to lead-in cables that pass through a wellhead. Such a configuration typically has a 180° bend (a "hairpin" bend) or turn located near a bottom of the heat source. An insulated conductor that includes a 180° bend or turn may not require a bottom termination, but the 180° bend or turn may be an electrical and/or structural weakness in the heater. Insulated conductors may be electrically coupled together in series, in parallel, or in series and parallel combinations. In some embodiments of heat sources, electrical current may pass into the conductor of an insulated conductor and may be returned through the jacket of the insulated conductor by connecting core 214 to jacket 218 (shown in FIG. 2) at the bottom of the heat source.

Figure 3:
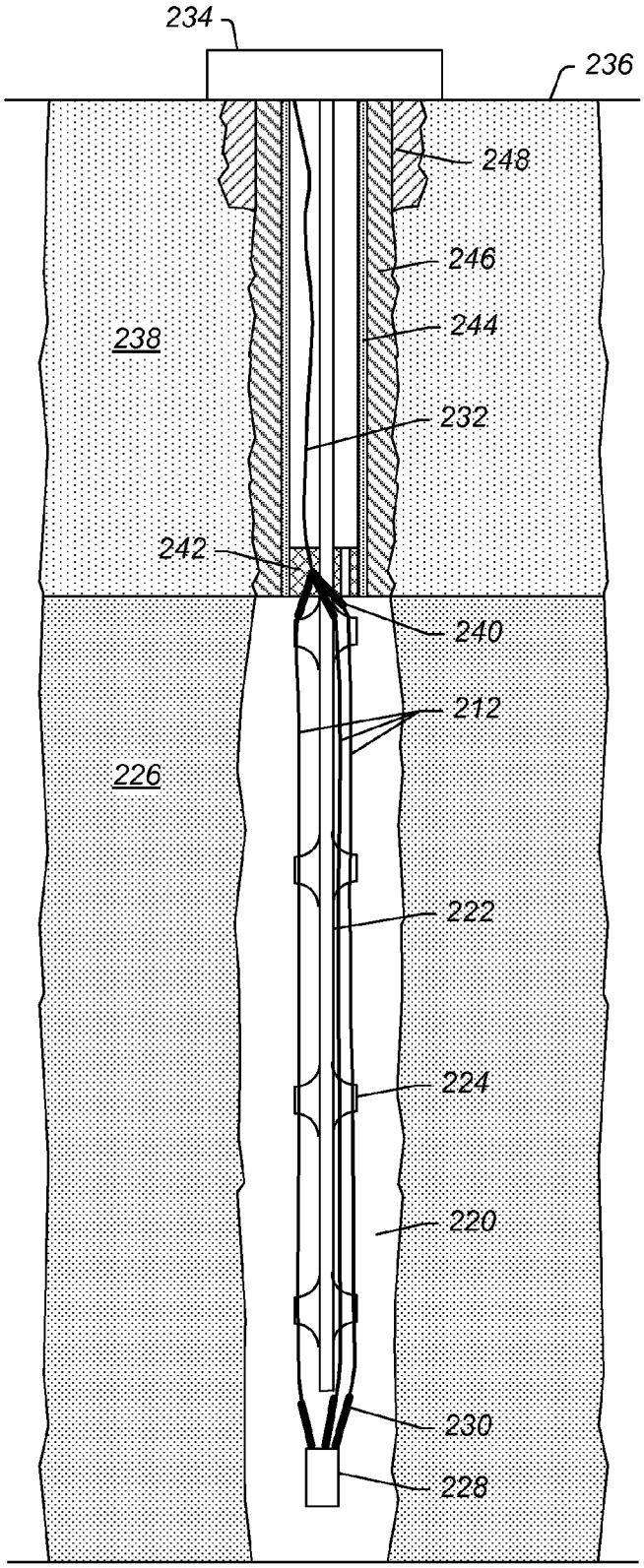
FIG. 3 depicts an embodiment of an insulated conductor heat source.
Figure 4:
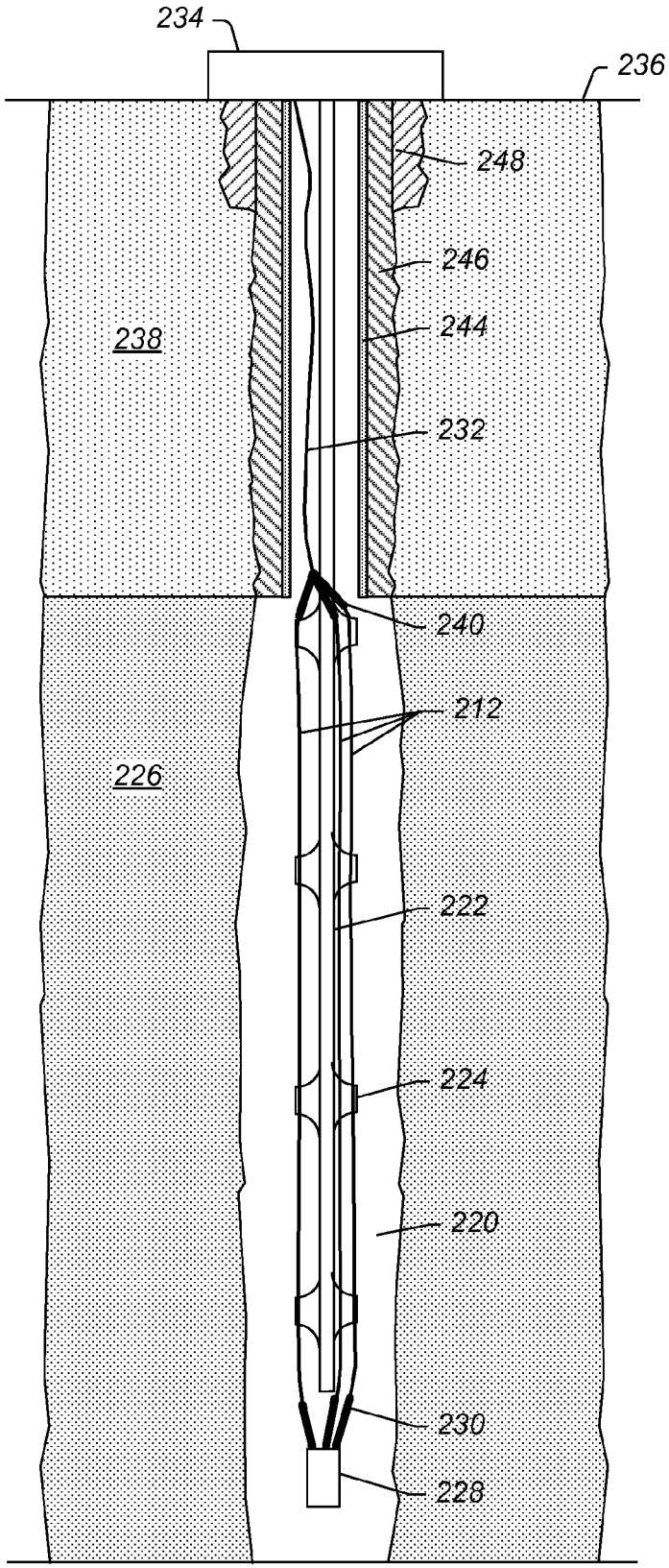
FIG. 4 depicts an embodiment of an insulated conductor heat source.

In some embodiments, three insulated conductors 212 are electrically coupled in a 3-phase wye configuration to a power supply. FIG. 3 depicts an embodiment of three insulated conductors in an opening in a subsurface formation coupled in a wye configuration. FIG. 4 depicts an embodiment of three insulated conductors 212 that are removable from opening 220 in the formation. No bottom connection may be required for three insulated conductors in a wye configuration. Alternately, all three insulated conductors of the wye configuration may be connected together near the bottom of the opening. The connection may be made directly at ends of heating sections of the insulated conductors or at ends of cold pins (less resistive sections) coupled to the heating sections at the bottom of the insulated conductors. The bottom connections may be made with insulator filled and sealed canisters or with epoxy filled canisters. The insulator may be the same composition as the insulator used as the electrical insulation.

Three insulated conductors 212 depicted in FIGS. 3 and 4 may be coupled to support member 222 using centralizers 224. Alternatively, insulated conductors 212 may be strapped directly to support member 222 using metal straps. Centralizers 224 may maintain a location and/or inhibit movement of insulated conductors 212 on support member 222. Centralizers 224 may be made of metal, ceramic, or combinations thereof. The metal may be stainless steel or any other type of metal able to withstand a corrosive and high temperature environment. In some embodiments, centralizers 224 are bowed metal strips welded to the support member at distances less than about 6 m. A ceramic used in centralizer 224 may be, but is not limited to, $Al_2O_3$, MgO, or another electrical insulator. Centralizers 224 may maintain a location of insulated conductors 212 on support member 222 such that movement of insulated conductors is inhibited at operating temperatures of the insulated conductors. Insulated conductors 212 may also be somewhat flexible to withstand expansion of support member 222 during heating.

Support member 222, insulated conductor 212, and centralizers 224 may be placed in opening 220 in hydrocarbon layer 226. Insulated conductors 212 may be coupled to bottom conductor junction 228 using cold pin 230. Bottom conductor junction 228 may electrically couple each insulated conductor 212 to each other. Bottom conductor junction 228 may include materials that are electrically conducting and do not melt at temperatures found in opening 220. Cold pin 230 may be an insulated conductor having lower electrical resistance than insulated conductor 212.

Lead-in conductor 232 may be coupled to wellhead 234 to provide electrical power to insulated conductor 212. Lead-in conductor 232 may be made of a relatively low electrical resistance conductor such that relatively little heat is generated from electrical current passing through the lead-in conductor. In some embodiments, the lead-in conductor is a rubber or polymer insulated stranded copper wire. In some embodiments, the lead-in conductor is a mineral insulated conductor with a copper core. Lead-in conductor 232 may couple to wellhead 234 at surface 236 through a sealing flange located between overburden 238 and surface 236. The sealing flange may inhibit fluid from escaping from opening 220 to surface 236.

In certain embodiments, lead-in conductor 232 is coupled to insulated conductor 212 using transition conductor 240. Transition conductor 240 may be a less resistive portion of insulated conductor 212. Transition conductor 240 may be referred to as "cold pin" of insulated conductor 212. Transition conductor 240 may be designed to dissipate about one-tenth to about one-fifth of the power per unit length as is dissipated in a unit length of the primary heating section of insulated conductor 212. Transition conductor 240 may typically be between about 1.5 m and about 15 m, although shorter or longer lengths may be used to accommodate specific application needs. In an embodiment, the conductor of transition conductor 240 is copper. The electrical insulator of transition conductor 240 may be the same type of electrical insulator used in the primary heating section. A jacket of transition conductor 240 may be made of corrosion resistant material.

In certain embodiments, transition conductor 240 is coupled to lead-in conductor 232 by a splice or other coupling joint. Splices may also be used to couple transition conductor 240 to insulated conductor 212. Splices may have to withstand a temperature equal to half of a target zone operating temperature. Density of electrical insulation in the splice should in many instances be high enough to withstand the required temperature and the operating voltage.

In some embodiments, as shown in FIG. 3, packing material 242 is placed between overburden casing 244 and opening 220. In some embodiments, reinforcing material 246 may secure overburden casing 244 to overburden 238. Packing material 242 may inhibit fluid from flowing from opening 220 to surface 236. Reinforcing material 246 may include, for example, Class G or Class H Portland cement mixed with silica flour for improved high temperature performance, slag or silica flour, and/or a mixture thereof. In some embodiments, reinforcing material 246 extends radially a width of from about 5 cm to about 25 cm.

As shown in FIGS. 3 and 4, support member 222 and lead-in conductor 232 may be coupled to wellhead 234 at surface 236 of the formation. Surface conductor 248 may enclose reinforcing material 246 and couple to wellhead 234. Embodiments of surface conductors may extend to depths of approximately 3 m to approximately 515 m into an opening in the formation. Alternatively, the surface conductor may extend to a depth of approximately 9 m into the formation. Electrical current may be supplied from a power source to insulated conductor 212 to generate heat due to the electrical resistance of the insulated conductor. Heat generated from three insulated conductors 212 may transfer within opening 220 to heat at least a portion of hydrocarbon layer 226.

Heat generated by insulated conductors 212 may heat at least a portion of a hydrocarbon containing formation. In some embodiments, heat is transferred to the formation substantially by radiation of the generated heat to the formation. Some heat may be transferred by conduction or convection of heat due to gases present in the opening. The opening may be an uncased opening, as shown in FIGS. 3 and 4. An uncased opening eliminates cost associated with thermally cementing the heater to the formation, costs associated with a casing, and/or costs of packing a heater within an opening. In addition, heat transfer by radiation is typically more efficient than by conduction, so the heaters may be operated at lower temperatures in an open wellbore. Conductive heat transfer during initial operation of a heat source may be enhanced by the addition of a gas in the opening. The gas may be maintained at a pressure up to about 27 bars absolute. The gas may include, but is not limited to, carbon dioxide and/or helium. An insulated conductor heater in an open wellbore may advantageously be free to expand or contract to accommodate thermal expansion and contraction. An insulated conductor heater may advantageously be removable or redeployable from an open wellbore.

In certain embodiments, an insulated conductor heater assembly is installed or removed using a spooling assembly. More than one spooling assembly may be used to install both the insulated conductor and a support member simultaneously. Alternatively, the support member may be installed using a coiled tubing unit. The heaters may be un-spooled and connected to the support as the support is inserted into the well. The electric heater and the support member may be un-spooled from the spooling assemblies. Spacers may be coupled to the support member and the heater along a length of the support member. Additional spooling assemblies may be used for additional electric heater elements.

Temperature limited heaters may be in configurations and/or may include materials that provide automatic temperature limiting properties for the heater at certain temperatures. Examples of temperature limited heaters may be found in U.S. Pat. No. 6,688,387 to Wellington et al.; U.S. Pat. No. 6,991,036 to Sumnu-Dindoruk et al.; U.S. Pat. No. 6,698,515 to Karanikas et al.; U.S. Pat. No. 6,880,633 to Wellington et al.; U.S. Pat. No. 6,782,947 to de Rouffignac et al.; U.S. Pat. No. 6,991,045 to Vinegar et al.; U.S. Pat. No. 7,073,578 to Vinegar et al.; U.S. Pat. No. 7,121,342 to Vinegar et al.; U.S. Pat. No. 7,320,364 to Fairbanks; U.S. Pat. No. 7,527,094 to McKinzie et al.; U.S. Pat. No. 7,584,789 to Mo et al.; U.S. Pat. No. 7,533,719 to Hinson et al.; and U.S. Pat. No. 7,562,707 to Miller; U.S. Patent Application Publication Nos. 2009-0071652 to Vinegar et al.; 2009-0189617 to Burns et al.; 2010-0071903 to Prince-Wright et al.; and 2010-0096137 to Nguyen et al.; each of which is incorporated by reference as if fully set forth herein. Temperature limited heaters are dimensioned to operate with AC frequencies (for example, 60 Hz AC) or with modulated DC current.

In certain embodiments, ferromagnetic materials are used in temperature limited heaters. Ferromagnetic material may self-limit temperature at or near the Curie temperature of the material and/or the phase transformation temperature range to provide a reduced amount of heat when a time-varying current is applied to the material. In certain embodiments, the ferromagnetic material self-limits temperature of the temperature limited heater at a selected temperature that is approximately the Curie temperature and/or in the phase transformation temperature range. In certain embodiments, the selected temperature is within about 35° C., within about 25° C., within about 20° C., or within about 10° C. of the Curie temperature and/or the phase transformation temperature range. In certain embodiments, ferromagnetic materials are coupled with other materials (for example, highly conductive materials, high strength materials, corrosion resistant materials, or combinations thereof) to provide various electrical and/or mechanical properties. Some parts of the temperature limited heater may have a lower resistance (caused by different geometries and/or by using different ferromagnetic and/or non-ferromagnetic materials) than other parts of the temperature limited heater. Having parts of the temperature limited heater with various materials and/or dimensions allows for tailoring the desired heat output from each part of the heater.

Temperature limited heaters may be more reliable than other heaters. Temperature limited heaters may be less apt to break down or fail due to hot spots in the formation. In some embodiments, temperature limited heaters allow for substantially uniform heating of the formation. In some embodiments, temperature limited heaters are able to heat the formation more efficiently by operating at a higher average heat output along the entire length of the heater. The temperature limited heater operates at the higher average heat output along the entire length of the heater because power to the heater does not have to be reduced to the entire heater, as is the case with typical constant wattage heaters, if a temperature along any point of the heater exceeds, or is about to exceed, a maximum operating temperature of the heater. Heat output from portions of a temperature limited heater approaching a Curie temperature and/or the phase transformation temperature range of the heater automatically reduces without controlled adjustment of the time-varying current applied to the heater. The heat output automatically reduces due to changes in electrical properties (for example, electrical resistance) of portions of the temperature limited heater. Thus, more power is supplied by the temperature limited heater during a greater portion of a heating process.

In certain embodiments, the system including temperature limited heaters initially provides a first heat output and then provides a reduced (second) heat output, near, at, or above the Curie temperature and/or the phase transformation temperature range of an electrically resistive portion of the heater when the temperature limited heater is energized by a time-varying current. The first heat output is the heat output at temperatures below which the temperature limited heater begins to self-limit. In some embodiments, the first heat output is the heat output at a temperature about 50° C., about 75° C., about 100° C., or about 125° C. below the Curie temperature and/or the phase transformation temperature range of the ferromagnetic material in the temperature limited heater.

The temperature limited heater may be energized by time-varying current (alternating current or modulated direct current) supplied at the wellhead. The wellhead may include a power source and other components (for example, modulation components, transformers, and/or capacitors) used in supplying power to the temperature limited heater. The temperature limited heater may be one of many heaters used to heat a portion of the formation.

In certain embodiments, the temperature limited heater includes a conductor that operates as a skin effect or proximity effect heater when time-varying current is applied to the conductor. The skin effect limits the depth of current penetration into the interior of the conductor. For ferromagnetic materials, the skin effect is dominated by the magnetic permeability of the conductor. The relative magnetic permeability of ferromagnetic materials is typically between 10 and 1000 (for example, the relative magnetic permeability of ferromagnetic materials is typically at least 10 and may be at least 50, 100, 500, 1000 or greater). As the temperature of the ferromagnetic material is raised above the Curie temperature, or the phase transformation temperature range, and/or as the applied electrical current is increased, the magnetic permeability of the ferromagnetic material decreases substantially and the skin depth expands rapidly (for example, the skin depth expands as the inverse square root of the magnetic permeability). The reduction in magnetic permeability results in a decrease in the AC or modulated DC resistance of the conductor near, at, or above the Curie temperature, the phase transformation temperature range, and/or as the applied electrical current is increased. When the temperature limited heater is powered by a substantially constant current source, portions of the heater that approach, reach, or are above the Curie temperature and/or the phase transformation temperature range may have reduced heat dissipation. Sections of the temperature limited heater that are not at or near the Curie temperature and/or the phase transformation temperature range may be dominated by skin effect heating that allows the heater to have high heat dissipation due to a higher resistive load.

An advantage of using the temperature limited heater to heat hydrocarbons in the formation is that the conductor is chosen to have a Curie temperature and/or a phase transformation temperature range in a desired range of temperature operation. Operation within the desired operating temperature range allows substantial heat injection into the formation while maintaining the temperature of the temperature limited heater, and other equipment, below design limit temperatures. Design limit temperatures are temperatures at which properties such as corrosion, creep, and/or deformation are adversely affected. The temperature limiting properties of the temperature limited heater inhibit overheating or burnout of the heater adjacent to low thermal conductivity "hot spots" in the formation. In some embodiments, the temperature limited heater is able to lower or control heat output and/or withstand heat at temperatures above 25° C., 37° C., 100° C., 250° C., 500° C., 700° C., 800° C., 900° C., or higher up to 1131° C., depending on the materials used in the heater.

The temperature limited heater allows for more heat injection into the formation than constant wattage heaters because the energy input into the temperature limited heater does not have to be limited to accommodate low thermal conductivity regions adjacent to the heater. For example, in Green River oil shale there is a difference of at least a factor of 3 in the thermal conductivity of the lowest richness oil shale layers and the highest richness oil shale layers. When heating such a formation, substantially more heat is transferred to the formation with the temperature limited heater than with the conventional heater that is limited by the temperature at low thermal conductivity layers. The heat output along the entire length of the conventional heater needs to accommodate the low thermal conductivity layers so that the heater does not overheat at the low thermal conductivity layers and burn out. The heat output adjacent to the low thermal conductivity layers that are at high temperature will reduce for the temperature limited heater, but the remaining portions of the temperature limited heater that are not at high temperature will still provide high heat output. Because heaters for heating hydrocarbon formations typically have long lengths (for example, at least 10 m, 100 m, 300 m, 500 m, 1 km or more up to about 10 km), the majority of the length of the temperature limited heater may be operating below the Curie temperature and/or the phase transformation temperature range while only a few portions are at or near the Curie temperature and/or the phase transformation temperature range of the temperature limited heater.

The use of temperature limited heaters allows for efficient transfer of heat to the formation. Efficient transfer of heat allows for reduction in time needed to heat the formation to a desired temperature. For example, in Green River oil shale, pyrolysis typically requires 9.5 years to 10 years of heating when using a 12 m heater well spacing with conventional constant wattage heaters. For the same heater spacing, temperature limited heaters may allow a larger average heat output while maintaining heater equipment temperatures below equipment design limit temperatures. Pyrolysis in the formation may occur at an earlier time with the larger average heat output provided by temperature limited heaters than the lower average heat output provided by constant wattage heaters. For example, in Green River oil shale, pyrolysis may occur in 5 years using temperature limited heaters with a 12 m heater well spacing. Temperature limited heaters counteract hot spots due to inaccurate well spacing or drilling where heater wells come too close together. In certain embodiments, temperature limited heaters allow for increased power output over time for heater wells that have been spaced too far apart, or limit power output for heater wells that are spaced too close together. Temperature limited heaters also supply more power in regions adjacent the overburden and underburden to compensate for temperature losses in these regions.

Temperature limited heaters may be advantageously used in many types of formations. For example, in tar sands formations or relatively permeable formations containing heavy hydrocarbons, temperature limited heaters may be used to provide a controllable low temperature output for reducing the viscosity of fluids, mobilizing fluids, and/or enhancing the radial flow of fluids at or near the wellbore or in the formation. Temperature limited heaters may be used to inhibit excess coke formation due to overheating of the near wellbore region of the formation.

In some embodiments, the use of temperature limited heaters eliminates or reduces the need for expensive temperature control circuitry. For example, the use of temperature limited heaters eliminates or reduces the need to perform temperature logging and/or the need to use fixed thermocouples on the heaters to monitor potential overheating at hot spots.

The temperature limited heaters may be used in conductor-in-conduit heaters. In some embodiments of conductor-in-conduit heaters, the majority of the resistive heat is generated in the conductor, and the heat radiatively, conductively and/or convectively transfers to the conduit. In some embodiments of conductor-in-conduit heaters, the majority of the resistive heat is generated in the conduit.

In some embodiments, a relatively thin conductive layer is used to provide the majority of the electrically resistive heat output of the temperature limited heater at temperatures up to a temperature at or near the Curie temperature and/or the phase transformation temperature range of the ferromagnetic conductor. Such a temperature limited heater may be used as the heating member in an insulated conductor heater. The heating member of the insulated conductor heater may be located inside a sheath with an insulation layer between the sheath and the heating member.

Mineral insulated (MI) cables (insulated conductors) are used in certain embodiments to provide heat to subsurface formations with overburdens. To avoid heating in the overburden (and wasting heat energy costs in the overburden), insulated conductors with conductive cores (for example, copper cores) are typically used in the overburden. The copper core insulated conductor in the overburden provides little to no heat in the overburden because of the copper core. Coupling the copper core insulated conductor to the heating insulated conductor (the heating section of the insulated conductor used in the hydrocarbon containing layer) may be difficult as the cores of the heating insulated conductor and the overburden insulated conductor typically are not matched well for welding together the cores. Typically, a transition insulated conductor is coupled between the overburden insulated conductor and the heating insulated conductor. The core of the transition insulated conductor typically bridges the materials gap between the other cores in the overburden and the heating section.

Typically, coupling the transition insulated conductor between the overburden insulated conductor and the heating insulated conductor involves welding separate sections of insulated conductor together including external welds to join the sheaths (jackets) of the different insulated conductor sections together. Such external welds may not be suitable, however, for spooling or other heater installation or transport techniques.

In addition, some joining (welding) techniques between cores of the insulated conductors cause necking or bulging at the joints during mill processing (for example, cold working or reduction of the outer diameter of the insulated conductor). Necking or bulging causes the outside diameter of the joint to vary and the joined insulated conductor to not have a smooth outer surface. The bulging may be caused by differences in the strengths between the cores of the joined insulated conductors and, in some cases, the welding filler. For example, welding a carbon steel core to a copper core with a copper-nickel welding filler can cause bulging during mill processing. The bulging insulated conductors are not suitable for spooling and can lead to mechanical or electrical problems during use in the subsurface formation.

To inhibit bulging, the welding filler may be a material that bridges the differences in the strengths between materials (welding filler is in between strengths of materials of joined cores). In certain embodiments, the welding filler has less than about 20% mismatch in strength from either of the materials being joined. For example, a 10% nickel/90% by weight copper welding filler may be within 20% of the strength of pure copper core material and within 20% of Alloy 180 core material (28% nickel/72% by weight copper). Typically, the welding filler may be as close to pure copper (used in the overburden) as possible while still being weldable to the material used for the core of the heating insulated conductor. Using such welding filler inhibits bulging or kinking at the joint of the insulated conductors and allows for spooling of the entire insulated conductor assembly (the assembly including the overburden section, the heating section, and any transition section needed).

In some embodiments, overburden insulated conductors and heating insulated conductors have different diameter cores. The diameter of the cores may depend on the desired heating in the heating insulated conductor and the voltage applied to the insulated conductor assembly. It may be desirable for the overburden core to be as large as possible in diameter to inhibit any type of heating (energy loss or wasted current) in the overburden. Thus, the core of the overburden insulated conductor may be larger than the core of the heating insulated conductor. Joining insulated conductors with different size cores may be difficult and, in some cases, may involve joining insulated conductors with different outside diameters to compensate for the different size cores. Joining insulated conductors of different outside diameters, however, is not desirable for spooling of the insulated conductor assembly.

In certain embodiments, the insulated conductors with the different sized cores are joined (spliced) together with a separate splice component. The separate splice component may have a larger outside diameter than either of the insulated conductors. Because the separate splice component has a larger outside diameter, the separate splice component may limit the bend radius of the overall heater due to strain limitations of the separate splice component. Strain limitations on the separate splice component are typically lower than the strain limitations of the insulated conductors because of the larger diameter. Thus, the heater with the separate splice component may have to be spooled on a large diameter spool to inhibit overstraining of the splice component. Thus, a joint (coupling) that allows joining (coupling) of insulated conductors with different core diameters while maintaining a continuous outside diameter (sheath diameter) is desired.

Figure 5:
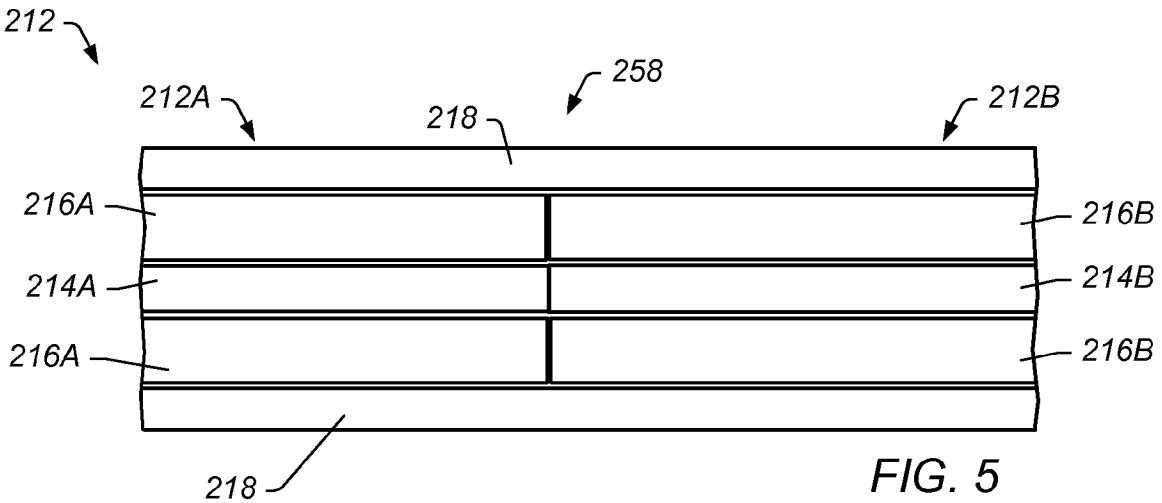
FIG. 5 depicts a side-view representation of an embodiment of a coupling for joining an overburden section and a heating section of an insulated conductor with cores of the sections having substantially similar diameters.

FIG. 5 depicts a side-view representation of an embodiment of coupling 258 for joining overburden section 212A and heating section 212B of insulated conductor 212 with cores 214A, B of the sections having substantially similar diameters. Other examples of coupling/splicing techniques are provided in U.S. Patent Publication Nos. 2011-0124228 to Coles et al. and 2012-0090174 to Coles et al. As shown in FIG. 5, core 214A and core 214B have substantially similar diameters but are made of different materials. For example, core 214A may be made of a highly conductive metal such as copper while core 214B is made of a resistively heating material such as Alloy 180 or another ferromagnetic material. Cores 214A, 214B may be joined by, for example, welding or brazing. In some embodiments, a welding filler as described herein is used to assist in joining cores 214A, 214B.

The use of the substantially similar diameter cores 214A, 214B allows electrical insulators 216A, 216B and jacket 218 to be substantially similar in size. In certain embodiments, jacket 218 is a continuous jacket along the length of insulated conductor 212. Insulated conductor 212 may be a continuous, substantially constant diameter insulated conductor with overburden section 212A and heating section 212B having substantially similar outer diameters. The use of core 214A with the same diameter as core 214B, however, may increase energy losses in overburden section 212A versus a core with a larger diameter. The larger diameter core may decrease energy losses (wasted current) by providing less resistance (more conductance) in overburden section 212A. Larger diameter cores with less energy losses may be more important particularly for relatively long length overburden sections (for example, lengths of about 50 m or more). Thus, it may be desirable to provide a continuous outside diameter insulated conductor 212 (jacket 218 has a continuous outside diameter) with different size cores within the jacket.

Figure 6:
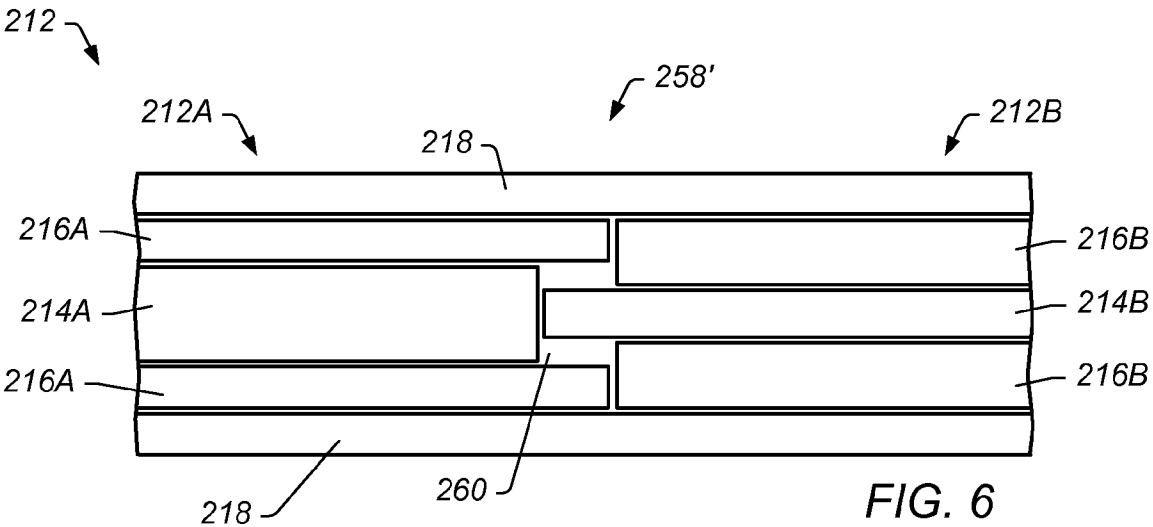
FIG. 6 depicts a side-view representation of an embodiment of a coupling for joining an overburden section of an insulated conductor with a larger diameter core to a heating section of the insulated conductor with a smaller diameter core.

FIG. 6 depicts a side-view representation of an embodiment of a coupling for joining overburden section 212A of insulated conductor 212 with a larger diameter core to heating section 212B of the insulated conductor with a smaller diameter core. Coupling 258' may join core 214A and core 214B inside continuous jacket 218. Core 214A may be the core used for overburden section 212A of insulated conductor 212. For example, core 214A may be a copper core. Core 214B may be the core used for heating section 212B of insulated conductor 212. Core 214B may be, for example, Alloy 180 or another ferromagnetic material. In some embodiments, core 214B is the core used for a transition section of insulated conductor 212 (the section between the overburden section and the heating section of the insulated conductor). Jacket 218 may be stainless steel (such as 304 stainless steel) or another suitable jacket material.

In certain embodiments, core 214A is joined to core 214B using, for example, a welding process using a welding filler as described herein. In some embodiments, core 214A is press-fit to core 214B. Core 214B may have a much smaller diameter than core 214A, as shown in FIG. 6. For example, core 214B may be smaller in diameter than core 214A by a factor of about 2, about 3, about 4, or more.

Because of the differences in diameters between core 214A and core 214B, the thickness of electrical insulator 216A around core 214A is different than the thickness of electrical insulator 216B around core 214B to maintain the continuous diameter of jacket 218. Electrical insulator 216A and/or electrical insulator 216B may be made of blocks of electrically insulating material. In certain embodiments, as shown in FIG. 6, electrical insulator 216A extends beyond the end of core 214A and overlaps the end of core 214B. The overlap of electrical insulator 216A forms gap 260 between electrical insulator 216B and core 214A. In certain embodiments, gap 260 is about 1" in (about 2.5 cm) length. In some embodiments, gap 260 has a length between about 0.25" (about 0.6 cm) and about 2" (about 5 cm) or between about 0.5" (about 1.2 cm) and about 1.5" (about 3.8 cm).

In certain embodiments, gap 260 is at least partially filled with electrical insulator material during compaction and/or heating of the insulated conductor assembly. In some embodiments, gap 260 is substantially completely filled with electrical insulator material during compaction and/or heating of the insulated conductor assembly. For example, electrical insulator 216A and/or electrical insulator 216B will flow and fill gap 260 when the outside diameter of the insulated conductor assembly is reduced during a cold working process and/or during an annealing process. The amount of filling of gap 260 with electrical insulator material may depend on the amount of compaction of the insulated conductor assembly and/or the time and temperature of the annealing process.

In some embodiments, electrical insulator filling gap 260 is not as compacted as electrical insulator in other parts of the insulated conductor assembly. Thus, gap 260 may have a slightly higher pore volume and less desirable electrical insulating properties. Coupling 258' may be suitable for use in the insulated conductor assembly, however, because the coupling is short in length compared to the rest of the insulated conductor assembly, the lower electrical insulating properties at the coupling may not adversely affect overall operation of the insulated conductor assembly.

Figure 7:
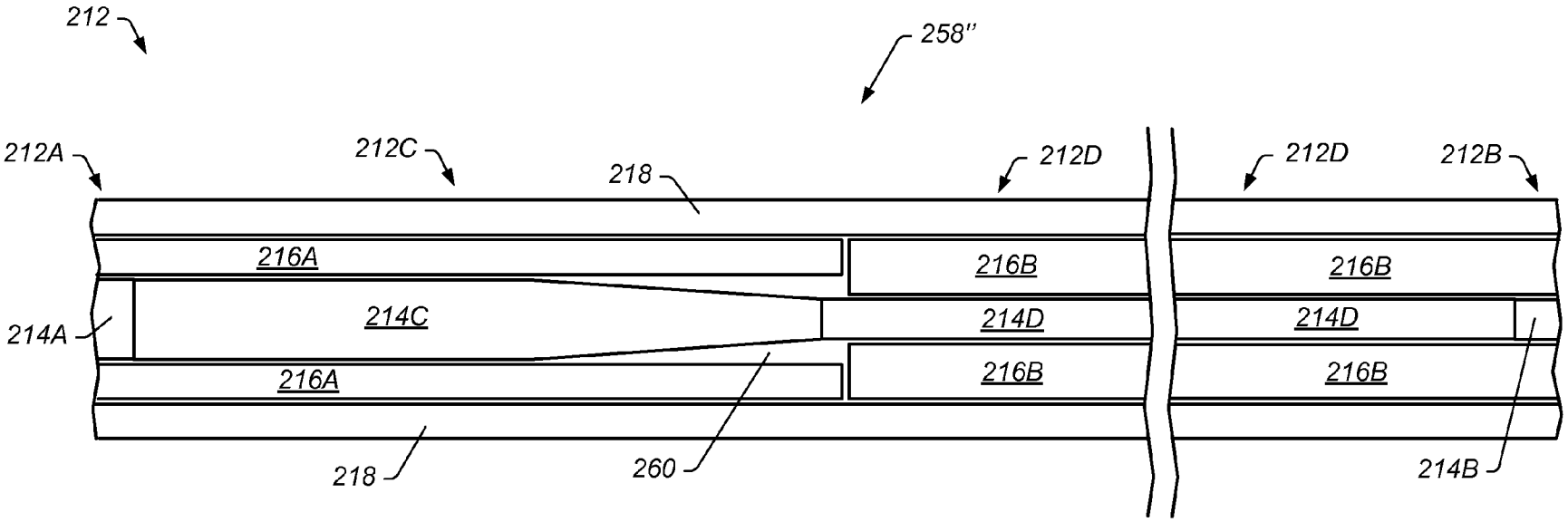
FIG. 7 depicts a side-view representation of another embodiment of a coupling for joining an overburden section of an insulated conductor with a larger diameter core to a heating section of the insulated conductor with a smaller diameter core.

FIG. 7 depicts a side-view representation of another embodiment of a coupling for joining overburden section 212A of insulated conductor 212 with a larger diameter core to heating section 212B of the insulated conductor with a smaller diameter core. In certain embodiments, coupling 258" joins overburden section 212A to heating section 212B using transition sections 212C, 212D to form insulated conductor 212. Core 214A of overburden section 212A may have a desired diameter to minimize energy losses in the overburden section. Core 214B of heating section 212B may have a desired diameter for providing heat to a subsurface formation (for example, a hydrocarbon containing formation). In certain embodiments, core 214A is copper and core 214B is Alloy 180 or another ferromagnetic material.

In certain embodiments, core 214C of transition section 212C and/or core 214D of transition section 212D are substantially the same material as core 214A of overburden section 212A. For example, cores 214A, 214C, 214D may be copper cores. Thus, cores 214A, 214C, 214D may be joined using conventional techniques for joining similar materials (for example, copper-to-copper welding techniques). Core 214D may be joined to core 214B using techniques described herein for joining dissimilar materials (for example, using a welding filler as described herein).

In certain embodiments, core 214C tapers from a larger diameter to a smaller diameter along a portion of its length. For example, core 214C may taper from the diameter of core 214A to the diameter of core 214D, which has substantially the same diameter as core 214B. Thus, core 214C transitions from the diameter of core 214A in overburden section 212A to core 214B in heating section 212B. The taper of core 214C may be formed, for example, by machining, drawing down through a die, or other known techniques for tapering copper or similar materials. The length of the taper of core 214C may be selected as desired to be a portion of the total length of the core. In one embodiment, core 214C has a length of about 5 feet (about 1.5 m). In such an embodiment, the length of the taper of core 214C may be, for example, about 3" (about 7.6 cm), about 6" (about 15.2 cm), or about 12" (about 30.5 cm). The length of core 214C and the length of the taper may vary, however, depending on, for example, the overall length of insulated conductor 212 and/or desired properties of the overburden section, the heating section, and/or the transition sections of the insulated conductor.

The smaller diameter end of core 214C is joined (for example, welded) to core 214D. At the junction of the two cores, the cores are substantially the same diameter. Electrical insulator 216A and electrical insulator 216B may be placed around the cores inside jacket 218. Electrical insulator 216A may be smaller in diameter than electrical insulator 216B because electrical insulator 216A is placed around the larger diameter cores while electrical insulator 216B is placed around the smaller diameter cores. In some embodiments, electrical insulator 216A is placed up to or near the junction between core 214C and core 214D. Similarly, electrical insulator 216B may be placed up to or near the junction between core 214C and core 214D. In certain embodiments, as shown in FIG. 7, electrical insulator 216A extends beyond the end of core 214C and overlaps the end of core 214D. Because of the taper of 214C, gap 260 may be formed at or near the junction between core 214C and core 214D. As described above for the embodiment depicted in FIG. 6, gap 260 may be at least partially filled with electrical insulator material during compaction and/or heating of the insulated conductor assembly.

Because the dimensions (for example, the diameter of the core) change in transition section 212C, there may be electrical field concentrations in transition section 212C. It may be desirable to have such electrical field concentrations occur in a section of insulated conductor 212 that is "warm" rather than "hot" like heating section 212B. Transition section 212D may provide a transition between heating section 212B and transition section 212C (the location of where the dimensions (diameter) of the core changes). Transition section 212D provides a warm transition between the hot heating section 212B and transition section 212C because of the use of copper (or similar conductive material) in the core of transition section 212D. Thus, heat from heating section 212B is dissipated along transition section 212D before the dimensional changes occur in transition section 212C.

In some embodiments, transition section 212D has a length of about 40 feet (about 12 m). The length of transition section 212D may vary, however, depending on, for example, the overall length of insulated conductor 212, the heat output in heating section 212B, and/or other mechanical or electrical properties of components in any of sections 212A, 212B, 212C, 212D of the insulated conductor.

Using coupling 258' or coupling 258" in the insulated conductor assembly to join the overburden section to the transition or heating section allows a continuous outside diameter insulated conductor assembly to be provided with a larger conductor in the overburden section of the insulated conductor. The larger conductor in the overburden section minimizes energy losses and/or wasted current in the overburden. Coupling 258' and coupling 258" improve the reliability of the insulated conductor by eliminating the need for a separate, external coupling component. Coupling 258' and coupling 258" may also reduce overall costs for the insulated conductor by eliminating the cost of the separate coupling component and/or reducing the assembly time for the insulated conductor. Assembly time for the insulated conductor may be reduced because of the elimination of the need for the separate coupling component and/or because use of coupling 258' and/or coupling 258" allows the insulated conductor to be made using current manufacturing processes with minor adjustments. The continuous outside diameter insulated conductor assembly can be spooled onto a smaller diameter spool, which is sized based on the strain limitations of the insulated conductor rather than the coupling joint (splice). The insulated conductor may be easily installed into an opening in a subsurface formation from the smaller diameter spool.

It is to be understood the invention is not limited to particular systems described which may, of course, vary. It is also to be understood that the terminology used herein is for the purpose of describing particular embodiments only, and is not intended to be limiting. As used in this specification, the singular forms "a", "an" and "the" include plural referents unless the content clearly indicates otherwise. Thus, for example, reference to "a core" includes a combination of two or more cores and reference to "a material" includes mixtures of materials.

In this patent, certain U.S. patents, U.S. patent applications, and other materials (for example, articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is clamed is:

1. A method for coupling a heating section and an overburden section of an insulated conductor heater, comprising:

coupling a core of the heating section to a core of the overburden section, wherein a diameter of the core of the heating section is less than a diameter of the core of the overburden section;

placing a first insulation layer comprising one or more blocks of insulation over the core of the heating section, wherein at least part of an end portion of the core of the heating section is exposed beyond an end of the blocks comprising the first insulation layer;

placing a second insulation layer comprising one or more blocks of insulation over the core of the overburden section, wherein at least one block at an end of the second insulation layer extends over the exposed portion of the core of the heating section with a gap between the at least one block and the exposed portion of the core, and wherein a thickness of the second insulation layer is less than a thickness of the first insulation layer and an outer diameter of the overburden section is substantially the same as an outer diameter of the heating section; and placing an outer electrical conductor around the heating section and the overburden section.

2. The method of claim 1, further comprising compacting the insulated conductor to reduce a cross-sectional area of the outer electrical conductor and compact the first insulation layer and the second insulation layer inside the outer electrical conductor.

3. The method of claim 2, wherein compaction of the second insulation layer fills the gap between the at least one block and the exposed portion of the core of the heating section.

4. The method of claim 1, wherein the core of the heating section comprises copper and nickel.

5. The method of claim 1, wherein the core of the overburden section comprises copper.

6. The method of claim 1, wherein the first insulation layer comprises magnesium oxide.

7. The method of claim 1, wherein the second insulation layer comprises magnesium oxide.

8. The method of claim 1, wherein the outer electrical conductor is placed around the heating section and the overburden section after the first insulation layer and the second insulation layer are placed over the cores of the heating section and the overburden section.

9. The method of claim 1, wherein the outer electrical conductor comprises a continuous outer electrical conductor between the heating section and the overburden section.

10. A method for coupling a heating section and an overburden section of an insulated conductor heater, comprising:

coupling a core of the heating section to a core of a first transition section, wherein a diameter of the first transition section core is substantially the same as a diameter of the heating section core;

coupling the first transition section core to a core of a second transition section, wherein a diameter of the second transition section core tapers from substantially the same diameter as the first transition section core at the coupling between the first transition section core and the second transition section core to a larger diameter along a length of the second transition section core;

coupling the second transition section core to a core of the overburden section, wherein a diameter of the overburden section core is substantially the same as the larger diameter of the second transition section core;

placing a first insulation layer over the heating section core and at least part of the first transition section core;

placing a second insulation layer over the overburden section core and at least part of the second transition section core, wherein a thickness of the second insulation layer is less than a thickness of the first insulation layer; and placing an outer electrical conductor around the first insulation layer and the second insulation layer, wherein outer diameters of the heating section, the first transition section, the second transition section, and the overburden section are substantially the same along a length of the insulated conductor heater.

11. The method of claim 10, further comprising compacting the insulated conductor to reduce a cross-sectional area of the outer electrical conductor and compact the first insulation layer and the second insulation layer inside the outer electrical conductor.

12. The method of claim 11, wherein compaction of the second insulation layer fills a gap between the second insulation layer and the second transition section core.

13. The method of claim 10, wherein the first transition section core, the second transition section core, and the overburden section core comprise substantially the same material.

14. The method of claim 13, wherein the heating section core comprises a different material than the first transition section core, the second transition section core, or the overburden section core.

15. The method of claim 10, wherein the heating section core comprises copper and nickel.

16. The method of claim 10, wherein the overburden section core comprises copper.

17. The method of claim 10, wherein the first transition section core comprises copper.

18. The method of claim 10, wherein the second transition section core comprises copper.

19. The method of claim 10, wherein the first insulation layer and the second insulation layer comprise magnesium oxide.

20. A coupling between a heating section and an overburden section of an insulated conductor heater, comprising:

a first transition section comprising a core with a diameter substantially the same as a diameter of a core of the heating section;

a second transition section comprising a core coupled to the first transition section core, wherein a diameter of the second transition section core tapers from substantially the same diameter as the first transition section core at the coupling between the first transition section core and the second transition section core to a larger diameter along a length of the second transition section core, and wherein a diameter of the overburden section core is substantially the same as the larger diameter of the second transition section core;

a first insulation layer placed over the heating section core and at least part of the first transition section core;

a second insulation layer placed over the overburden section core and at least part of the second transition section core, wherein a thickness of the second insulation layer is less than a thickness of the first insulation layer; and an outer electrical conductor placed around the first insulation layer and the second insulation layer, wherein outer diameters of the heating section, the first transition section, the second transition section, and the overburden section are substantially the same along a length of the insulated conductor heater.

21. The coupling of claim 20, wherein the first insulation layer at least partially overlaps the first transition section core.

22. The coupling of claim 20, wherein the first transition section core, the second transition section core, and the overburden section core comprise substantially the same material.

23. The coupling of claim 22, wherein the heating section core comprises a different material than the first transition section core, the second transition section core, or the overburden section core.

24. The coupling of claim 20, wherein the heating section core comprises copper and nickel.

25. The coupling of claim 20, wherein the overburden section core comprises copper.

26. The coupling of claim 20, wherein the first transition section core comprises copper.

27. The coupling of claim 20, wherein the second transition section core comprises copper.

28. The coupling of claim 20, wherein the first insulation layer and the second insulation layer comprise magnesium oxide.

29. The coupling of claim 20, wherein the outer electrical conductor comprises stainless steel.

* * * * *